US008517516B2

(12) United States Patent
Katerberg et al.

(10) Patent No.: US 8,517,516 B2
(45) **Date of Patent: *Aug. 27, 2013**

(54) FLOW-THROUGH LIQUID EJECTION USING COMPLIANT MEMBRANE TRANSDUCER

(75) Inventors: James A. Katerberg, Kettering, OH (US); James D. Huffman, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 225 days.

This patent is subject to a terminal disclaimer.

(21) Appl. No.: 13/089,632

(22) Filed: Apr. 19, 2011

(65) Prior Publication Data

US 2012/0268531 A1 Oct. 25, 2012

(51) Int. Cl.
*B41J 2/04* (2006.01)

(52) U.S. Cl.
USPC ..... 347/54; 347/65; 347/89

(58) Field of Classification Search
USPC ..... 347/20, 54, 665, 67, 68, 70–71, 84–87, 347/89
See application file for complete search history.

(56) References Cited

U.S. PATENT DOCUMENTS

| | | | | |
|---|---|---|---|---|
| 4,345,259 | A | 8/1982 | Reitberger | |
| 4,435,719 | A | 3/1984 | Snaper | |
| 5,156,306 | A | 10/1992 | Perera | |
| 6,464,347 | B2 | 10/2002 | Kneezel et al. | |
| 6,474,787 | B1 | 11/2002 | Cruz-Uribe | |
| 6,561,627 | B2 | 5/2003 | Jarrold et al. | |
| 7,073,890 | B2 * | 7/2006 | Cabal et al. | 347/54 |
| 7,571,992 | B2 | 8/2009 | Jia et al. | |
| 8,033,647 | B2 * | 10/2011 | Xie et al. | 347/54 |
| 2007/0291082 | A1 | 12/2007 | Baumer et al. | |
| 2009/0135223 | A1 | 5/2009 | Xie et al. | |
| 2009/0195612 | A1 | 8/2009 | Xie et al. | |

FOREIGN PATENT DOCUMENTS

| | | |
|---|---|---|
| EP | 0 436 509 | 7/1991 |
| WO | WO 95/10415 | 4/1995 |

OTHER PUBLICATIONS

Xie et al., U.S. Appl. No. 12/024,360, filed Feb. 1, 2008, "Liquid Drop Dispenser With Movable Deflector".

* cited by examiner

*Primary Examiner* — Juanita D Jackson
(74) *Attorney, Agent, or Firm* — Kevin E. Spaulding

(57) ABSTRACT

A method of ejecting a liquid includes providing a liquid dispenser including a substrate. A first portion of the substrate defines a liquid dispensing channel including an outlet opening. A second portion of the substrate defines a liquid supply channel and a liquid return channel. A diverter member is positioned on a wall of the liquid dispensing channel that includes the outlet opening. The diverter member includes a MEMS transducing member anchored to the wall of the liquid dispensing channel. A compliant membrane is positioned in contact with the MEMS transducing member. The diverter member is selectively actuated to divert a portion of the liquid flowing through the liquid dispensing channel through outlet opening of the liquid dispensing channel.

12 Claims, 36 Drawing Sheets

US Serial No. 13/089,632 filed 04/19/2011
REPLACEMENT SHEET

US Serial No. 13/089,632 filed 04/19/2011
REPLACEMENT SHEET

FLOW-THROUGH LIQUID EJECTION USING COMPLIANT MEMBRANE TRANSDUCER

CROSS REFERENCE TO RELATED APPLICATIONS

Reference is made to commonly-assigned, U.S. Patent Applications Publication No. 2012/0266686, entitled "MEMS COMPOSITE TRANSDUCER INCLUDING COMPLIANT MEMBRANE", Publication No. 2012/0270352, entitled "FABRICATING MEMS COMPOSITE TRANSDUCER INCLUDING COMPLIANT MEMBRANE", Publication No. 2012/0268527, entitled "FLOW-THROUGH EJECTION SYSTEM INCLUDING COMPLIANT MEMBRANE TRANSDUCER", Publication No. 2012/0268528, entitled "FLOW-THROUGH LIQUID EJECTION USING COMPLIANT MEMBRANE TRANSDUCER", Publication Ser. No. 13/089,610, entitled "FLOW-THROUGH EJECTION SYSTEM INCLUDING COMPLIANT MEMBRANE TRANSDUCER", all filed concurrently herewith.

FIELD OF THE INVENTION

This invention relates generally to the field of digitally controlled fluid dispensing systems and, in particular, to flow through liquid drop dispensers that eject on demand a quantity of liquid from a continuous flow of liquid.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfer and fixing. Ink jet printing mechanisms can be categorized by technology as either drop on demand ink jet (DOD) or continuous ink jet (CIJ).

The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection.

Printing systems that combine aspects of drop-on-demand printing and continuous printing are also known. These systems, often referred to as flow through liquid drop dispensers, provide increased drop ejection frequency when compared to drop-on-demand printing systems without the complexity of continuous printing systems.

Micro-Electro-Mechanical Systems (or MEMS) devices are becoming increasingly prevalent as low-cost, compact devices having a wide range of applications. As such, MEMS devices, for example, MEMS transducers, have been incorporated into both DOD and CIJ printing mechanisms.

MEMS transducers include both actuators and sensors that convert an electrical signal into a motion or they convert a motion into an electrical signal, respectively. Typically, MEMS transducers are made using standard thin film and semiconductor processing methods. As new designs, methods and materials are developed, the range of usages and capabilities of MEMS devices is be extended.

MEMS transducers are typically characterized as being anchored to a substrate and extending over a cavity in the substrate. Three general types of such transducers include a) a cantilevered beam having a first end anchored and a second end cantilevered over the cavity; b) a doubly anchored beam having both ends anchored to the substrate on opposite sides of the cavity; and c) a clamped sheet that is anchored around the periphery of the cavity. Type c) is more commonly called a clamped membrane, but the word membrane will be used in a different sense herein, so the term clamped sheet is used to avoid confusion.

Sensors and actuators can be used to sense or provide a displacement or a vibration. For example, the amount of deflection $\delta$ of the end of a cantilever in response to a stress $\sigma$ is given by Stoney's formula $$\delta=3\sigma(1-\nu)L^2/Et^2 \quad (1),$$

where $\nu$ is Poisson's ratio, E is Young's modulus, L is the beam length, and t is the thickness of the cantilevered beam. In order to increase the amount of deflection for a cantilevered beam, one can use a longer beam length, a smaller thickness, a higher stress, a lower Poisson's ratio, or a lower Young's modulus. The resonant frequency of vibration is given by $$\omega_0=(k/m)^{1/2}, \quad (2),$$

where k is the spring constant and m is the mass. For a cantilevered beam, the spring constant k is given by $$k=Ewt^3/4L^3 \quad (3),$$

where w is the cantilever width and the other parameters are defined above. For a lower resonant frequency one can use a smaller Young's modulus, a smaller width, a smaller thickness, a longer length, or a larger mass. A doubly anchored beam typically has a lower amount of deflection and a higher resonant frequency than a cantilevered beam having comparable geometry and materials. A clamped sheet typically has an even lower amount of deflection and an even higher resonant frequency.

Thermal stimulation of liquids, for example, inks, ejected from DOD printing mechanisms using a heater or formed by CIJ printing mechanisms using a heater is not consistent when one liquid is compared to another liquid. Some liquid properties, for example, stability and surface tension, react differently relative to temperature. As such, liquids are affected differently by thermal stimulation often resulting in inconsistent drop formation which reduces the numbers and types of liquid formulations used with DOD printing mechanisms or CIJ printing mechanisms.

Accordingly, there is an ongoing need to provide liquid ejection mechanisms and ejection methods that improve the reliability and consistency of drop formation on a liquid by liquid basis while maintaining individual nozzle control of the mechanism in order to increase the numbers and types of liquid formulations used with these mechanisms. There is also an ongoing effort to increase the reliability and performance of flow through liquid drop dispensers.

SUMMARY OF THE INVENTION

According to one aspect of the invention, a method of ejecting a liquid from a liquid dispenser includes providing a liquid dispenser including a substrate. A first portion of the substrate defines a liquid dispensing channel including an outlet opening. A second portion of the substrate defines a liquid supply channel and a liquid return channel. A diverter member is positioned on a wall of the liquid dispensing channel that includes the outlet opening. The diverter member includes a MEMS transducing member. A first portion of the MEMS transducing member is anchored to the wall of the liquid dispensing channel that includes the outlet opening. A second portion of the MEMS transducing member extends into a portion of the liquid dispensing channel that is adjacent to the outlet opening and is free to move relative to the outlet opening. A compliant membrane is positioned in contact with the MEMS transducing member. A first portion of the compliant membrane separates the MEMS transducing member from the liquid dispensing channel. A second portion of the compliant membrane is anchored to the wall of the liquid dispensing channel that includes the outlet opening. A continuous flow of liquid is provided from a liquid supply through the liquid supply channel through the liquid dispensing channel through the liquid return channel and back to the liquid supply. The diverter member is selectively actuated to divert a portion of the liquid flowing through the liquid dispensing channel through outlet opening of the liquid dispensing channel.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1A:
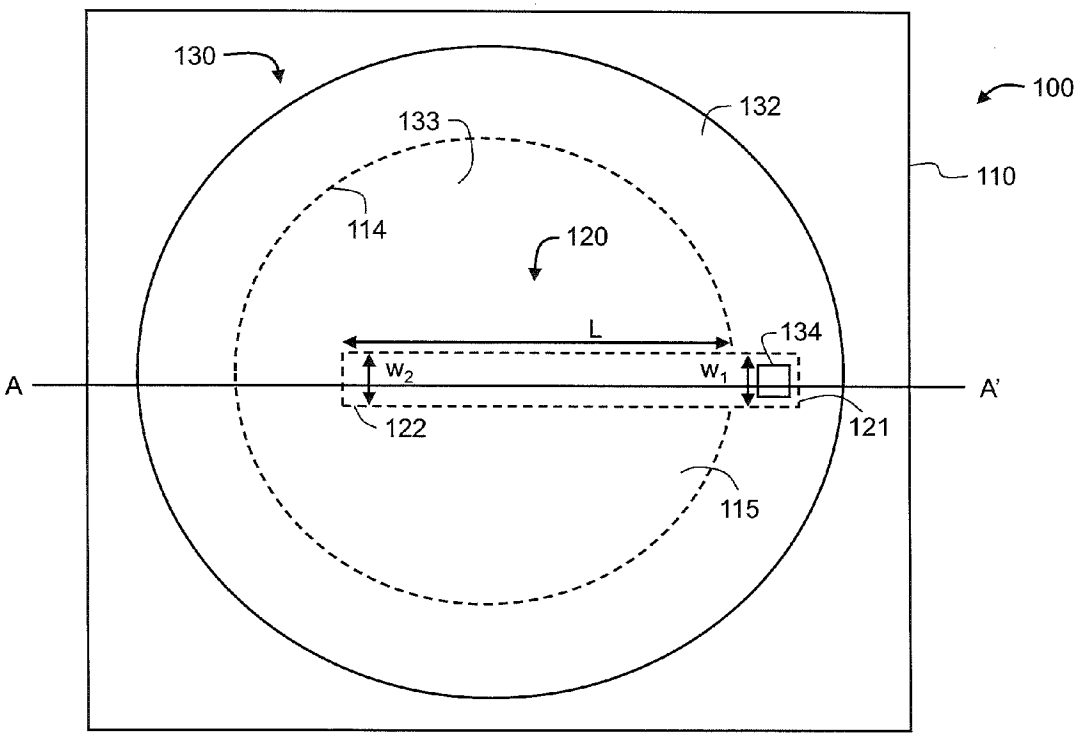
FIG. 1A is a top view and FIG. 1B is a cross-sectional view of an embodiment of a MEMS composite transducer including a cantilevered beam and a compliant membrane over a cavity.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide liquid ejection components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the liquid ejection system or the liquid ejection system components described below.

Embodiments of the present invention include a variety of types of MEMS transducers including a MEMS transducing member and a compliant membrane positioned in contact with the MEMS transducing member. It is to be noted that in some definitions of MEMS structures, MEMS components are specified to be between 1 micron and 100 microns in size. Although such dimensions characterize a number of embodiments, it is contemplated that some embodiments will include dimensions outside that range.

Figure 1B:
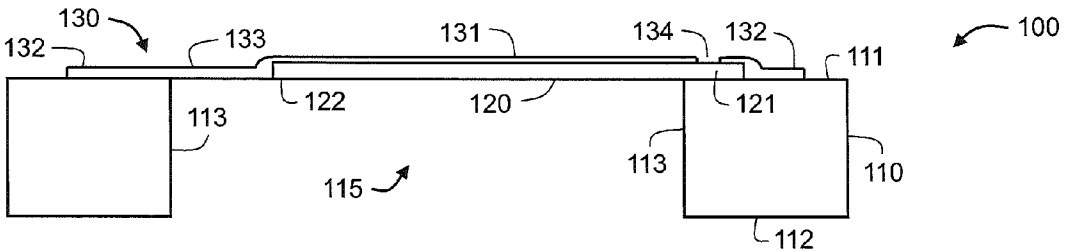

FIG. 1A shows a top view and FIG. 1B shows a cross-sectional view (along A-A') of a first embodiment of a MEMS composite transducer 100, where the MEMS transducing member is a cantilevered beam 120 that is anchored at a first end 121 to a first surface 111 of a substrate 110. Portions 113 of the substrate 110 define an outer boundary 114 of a cavity 115. In the example of FIGS. 1A and 1B, the cavity 115 is substantially cylindrical and is a through hole that extends from a first surface 111 of substrate 110 (to which a portion of the MEMS transducing member is anchored) to a second surface 112 that is opposite first surface 111. Other shapes of cavity 115 are contemplated for other embodiments in which the cavity 115 does not extend all the way to the second surface 112. Still other embodiments are contemplated where the cavity shape is not cylindrical with circular symmetry. A portion of cantilevered beam 120 extends over a portion of cavity 115 and terminates at second end 122. The length L of the cantilevered beam extends from the anchored end 121 to the free end 122. Cantilevered beam 120 has a width $w_1$ at first end 121 and a width $w_2$ at second end 122. In the example of FIGS. 1A and 1B, $w_1=w_2$, but in other embodiments described below that is not the case.

MEMS transducers having an anchored beam cantilevering over a cavity are well known. A feature that distinguishes the MEMS composite transducer 100 from conventional devices is a compliant membrane 130 that is positioned in contact with the cantilevered beam 120 (one example of a MEMS transducing member). Compliant membrane includes a first portion 131 that covers the MEMS transducing member, a second portion 132 that is anchored to first surface 111 of substrate 110, and a third portion 133 that overhangs cavity 115 while not contacting the MEMS transducing member. In a fourth region 134, compliant membrane 130 is removed such that it does not cover a portion of the MEMS transducing member near the first end 121 of cantilevered beam 120, so that electrical contact can be made as is discussed in further detail below. In the example shown in FIG. 1B, second portion 132 of compliant membrane 130 that is anchored to substrate 110 is anchored around the outer boundary 114 of cavity 115. In other embodiments, it is contemplated that the second portion 132 would not extend entirely around outer boundary 114.

Figure 2:
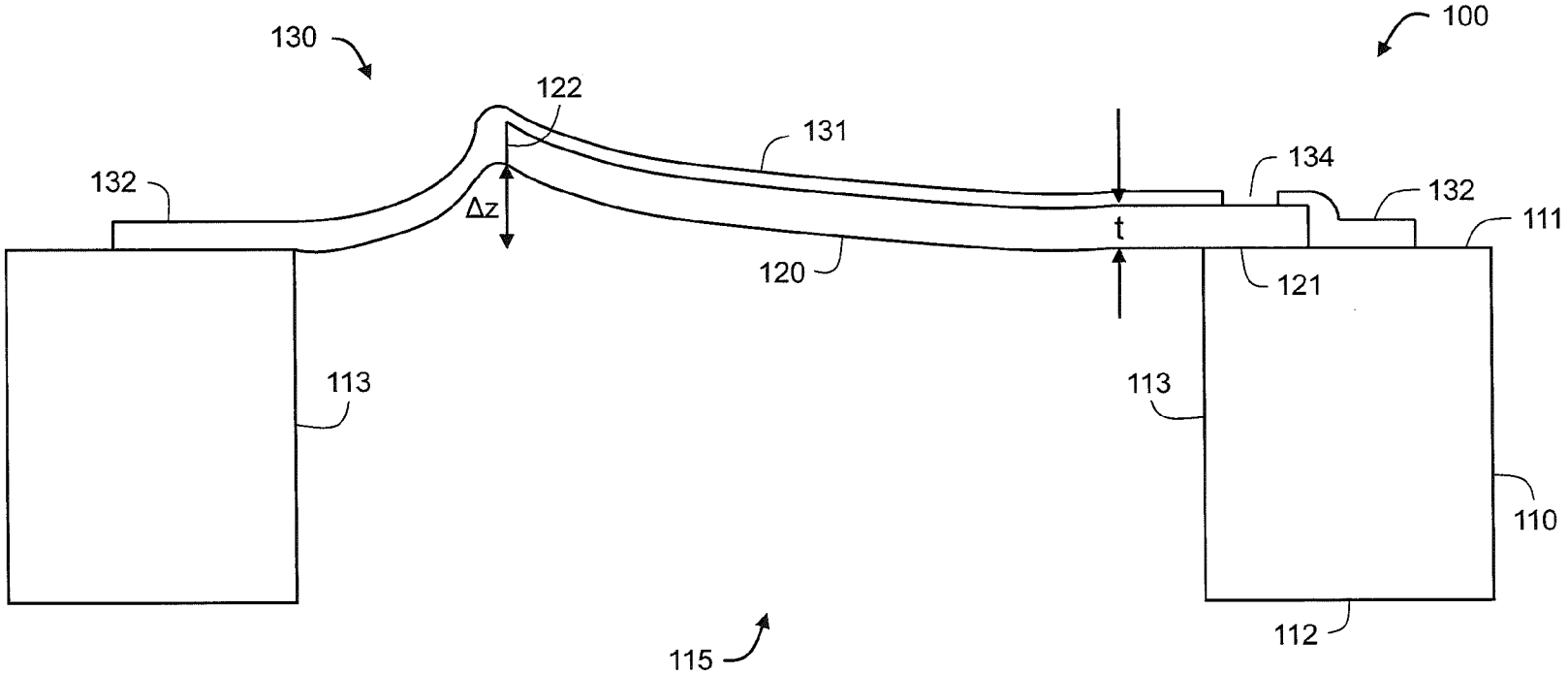
FIG. 2 is a cross-sectional view similar to FIG. 1B, where the cantilevered beam is deflected.

The portion (including end 122) of the cantilevered beam 120 that extends over at least a portion of cavity 115 is free to move relative to cavity 115. A common type of motion for a cantilevered beam is shown in FIG. 2, which is similar to the view of FIG. 1B at higher magnification, but with the cantilevered portion of cantilevered beam 120 deflected upward away by a deflection $\delta=\Delta z$ from the original undeflected position shown in FIG. 1B (the z direction being perpendicular to the x-y plane of the surface 111 of substrate 110). Such a bending motion is provided for example in an actuating mode by a MEMS transducing material (such as a piezoelectric material, or a shape memory alloy, or a thermal bimorph material) that expands or contracts relative to a reference material layer to which it is affixed when an electrical signal is applied, as is discussed in further detail below. When the upward deflection out of the cavity is released (by stopping the electrical signal), the MEMS transducer typically moves from being out of the cavity to into the cavity before it relaxes to its undeflected position. Some types of MEMS transducers have the capability of being driven both into and out of the cavity, and are also freely movable into and out of the cavity.

The compliant membrane 130 is deflected by the MEMS transducer member such as cantilevered beam 120, thereby providing a greater volumetric displacement than is provided by deflecting only cantilevered beam (of conventional devices) that is not in contact with a compliant membrane 130. Desirable properties of compliant membrane 130 are that it have a Young's modulus that is much less than the Young's modulus of typical MEMS transducing materials, a relatively large elongation before breakage, excellent chemical resistance (for compatibility with MEMS manufacturing processes), high electrical resistivity, and good adhesion to the transducer and substrate materials. Some polymers, including some epoxies, are well adapted to be used as a compliant membrane 130. Examples include TMMR liquid resist or TMMF dry film, both being products of Tokyo Ohka Kogyo Co. The Young's modulus of cured TMMR or TMMF is about 2 GPa, as compared to approximately 70 GPa for a silicon oxide, around 100 GPa for a PZT piezoelectric, around 160 GPa for a platinum metal electrode, and around 300 GPa for silicon nitride. Thus the Young's modulus of the typical MEMS transducing member is at least a factor of 10 greater, and more typically more than a factor of 30 greater than that of the compliant membrane 130. A benefit of a low Young's modulus of the compliant membrane is that the design can allow for it to have negligible effect on the amount of deflection for the portion 131 where it covers the MEMS transducing member, but is readily deflected in the portion 133 of compliant membrane 130 that is nearby the MEMS transducing member but not directly contacted by the MEMS transducing member. Furthermore, because the Young's modulus of the compliant membrane 130 is much less than that of the typical MEMS transducing member, it has little effect on the resonant frequency of the MEMS composite transducer 100 if the MEMS transducing member (e.g. cantilevered beam 120) and the compliant membrane 130 have comparable size. However, if the MEMS transducing member is much smaller than the compliant membrane 130, the resonant frequency of the MEMS composite transducer can be significantly lowered. In addition, the elongation before breaking of cured TMMR or TMMF is around 5%, so that it is capable of large deflection without damage.

There are many embodiments within the family of MEMS composite transducers 100 having one or more cantilevered beams 120 as the MEMS transducing member covered by the compliant membrane 130. The different embodiments within this family have different amounts of displacement or different resonant frequencies or different amounts of coupling between multiple cantilevered beams 120 extending over a portion of cavity 115, and thereby are well suited to a variety of applications.

Figure 3:
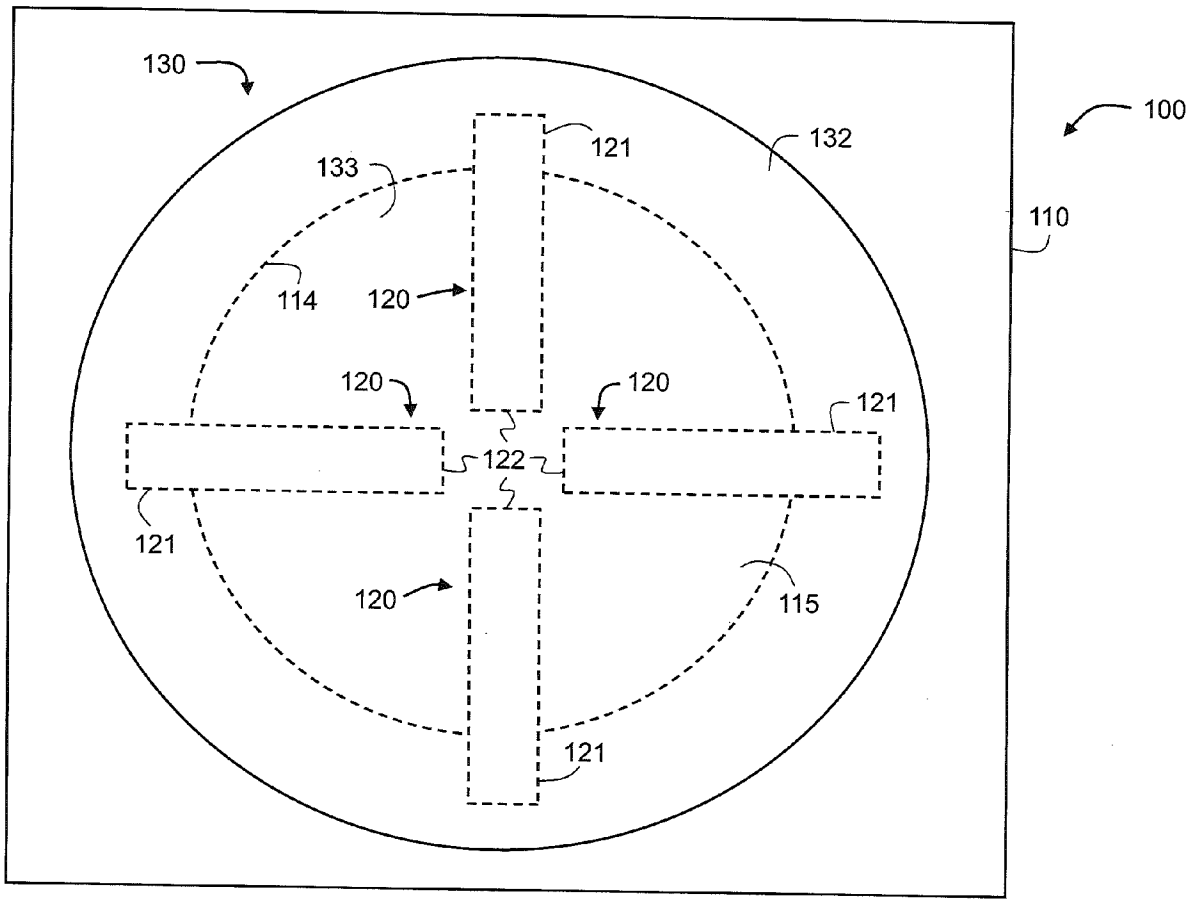
FIG. 3 is a top view of an embodiment similar to FIG. 1A, but with a plurality of cantilevered beams over the cavity.

FIG. 3 shows a top view of a MEMS composite transducer 100 having four cantilevered beams 120 as the MEMS transducing members, each cantilevered beam 120 including a first end that is anchored to substrate 110, and a second end 122 that is cantilevered over cavity 115. For simplicity, some details such as the portions 134 where the compliant membrane is removed are not shown in FIG. 3. In this example, the widths $w_1$ (see FIG. 1A) of the first ends 121 of the cantilevered beams 120 are all substantially equal to each other, and the widths $w_2$ (see FIG. 1A) of the second ends 122 of the cantilevered beams 120 are all substantially equal to each other. In addition, $w_1=w_2$ in the example of FIG. 3. Compliant membrane 130 includes first portions 131 that cover the cantilevered beams 120 (as seen more clearly in FIG. 1B), a second portion 132 that is anchored to substrate 110, and a third portion 133 that overhangs cavity 115 while not contacting the cantilevered beams 120. The compliant member 130 in this example provides some coupling between the different cantilevered beams 120. In addition, for embodiments where the cantilevered beams are actuators, the effect of actuating all four cantilevered beams 120 results in an increased volumetric displacement and a more symmetric displacement of the compliant membrane 130 than the single cantilevered beam 120 shown in FIGS. 1A, 1B and 2.

Figure 4:
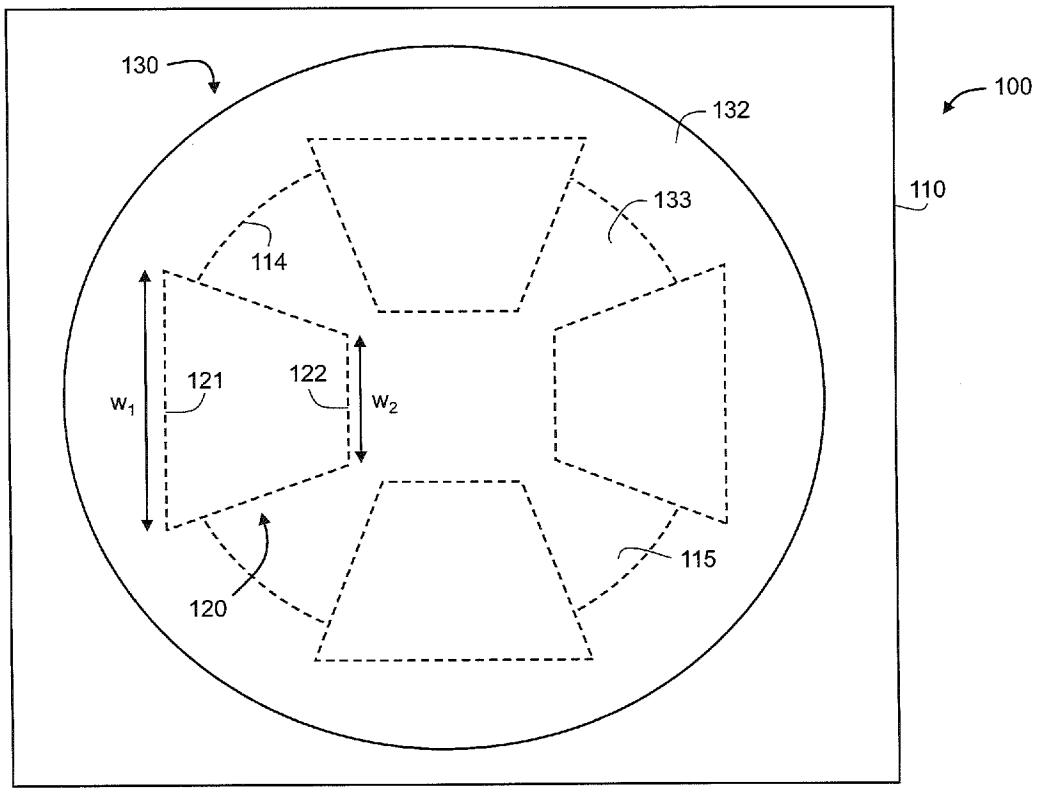
FIG. 4 is a top view of an embodiment similar to FIG. 3, but where the widths of the cantilevered beams are larger at their anchored ends than at their free ends.

FIG. 4 shows an embodiment similar to FIG. 3, but for each of the four cantilevered beams 120, the width $w_1$ at the anchored end 121 is greater than the width $w_2$ at the cantilevered end 122. For embodiments where the cantilevered beams 120 are actuators, the effect of actuating the cantilevered beams of FIG. 4 provides a greater volumetric displacement of compliant membrane 130, because a greater portion of the compliant membrane is directly contacted and supported by cantilevered beams 120. As a result the third portion 133 of compliant membrane 130 that overhangs cavity 115 while not contacting the cantilevered beams 120 is smaller in FIG. 4 than in FIG. 3. This reduces the amount of sag in third portion 133 of compliant membrane 130 between cantilevered beams 120 as the cantilevered beams 120 are deflected.

Figure 5:
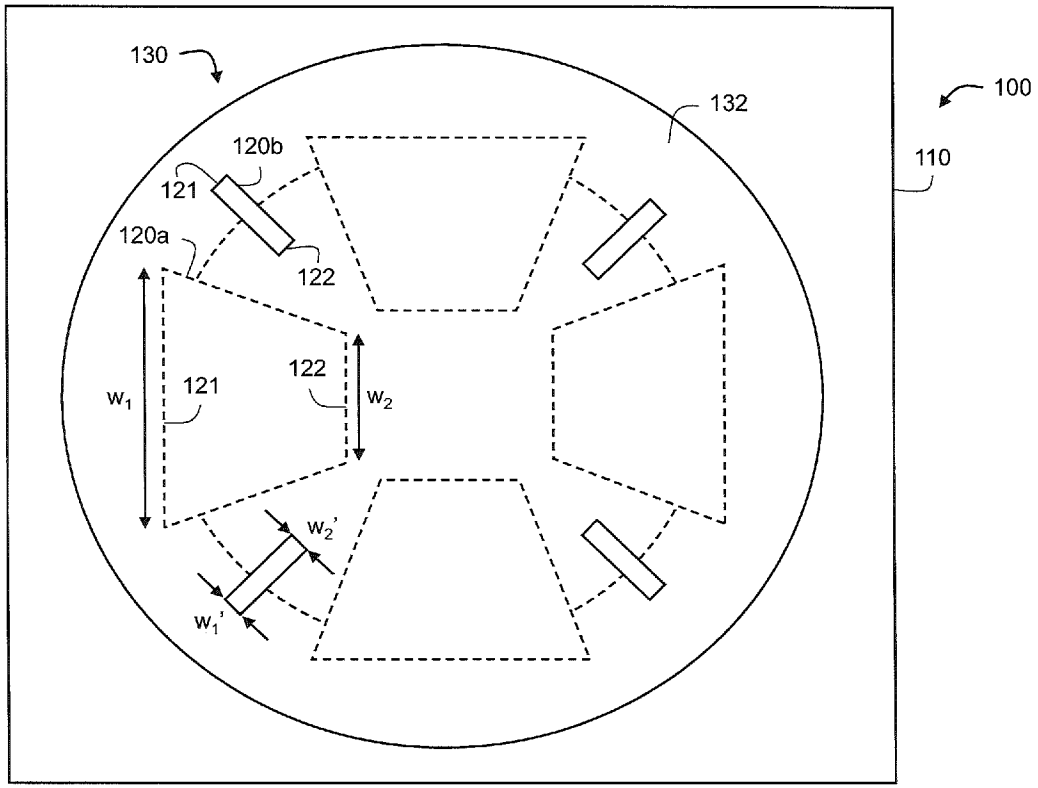
FIG. 5 is a top view of an embodiment similar to FIG. 4, but in addition including a second group of cantilevered beams having a different shape.

FIG. 5 shows an embodiment similar to FIG. 4, where in addition to the group of cantilevered beams 120*a* (one example of a MEMS transducing member) having larger first widths $w_1$ than second widths $w_2$, there is a second group of cantilevered beams 120*b* (alternatingly arranged between elements of the first group) having first widths $w_1'$ that are equal to second widths $w_2'$. Furthermore, the second group of cantilevered beams 120*b* are sized smaller than the first group of cantilevered beams 120*a*, such that the first widths we are smaller than first widths $w_1$, the second widths $w_2'$ are smaller than second widths $w_2$, and the distances (lengths) between the anchored first end 121 and the free second end 122 are also smaller for the group of cantilevered beams 120*b*. Such an arrangement is beneficial when the first group of cantilevered beams 120*a* are used for actuators and the second group of cantilevered beams 120*b* are used as sensors.

Figure 6:
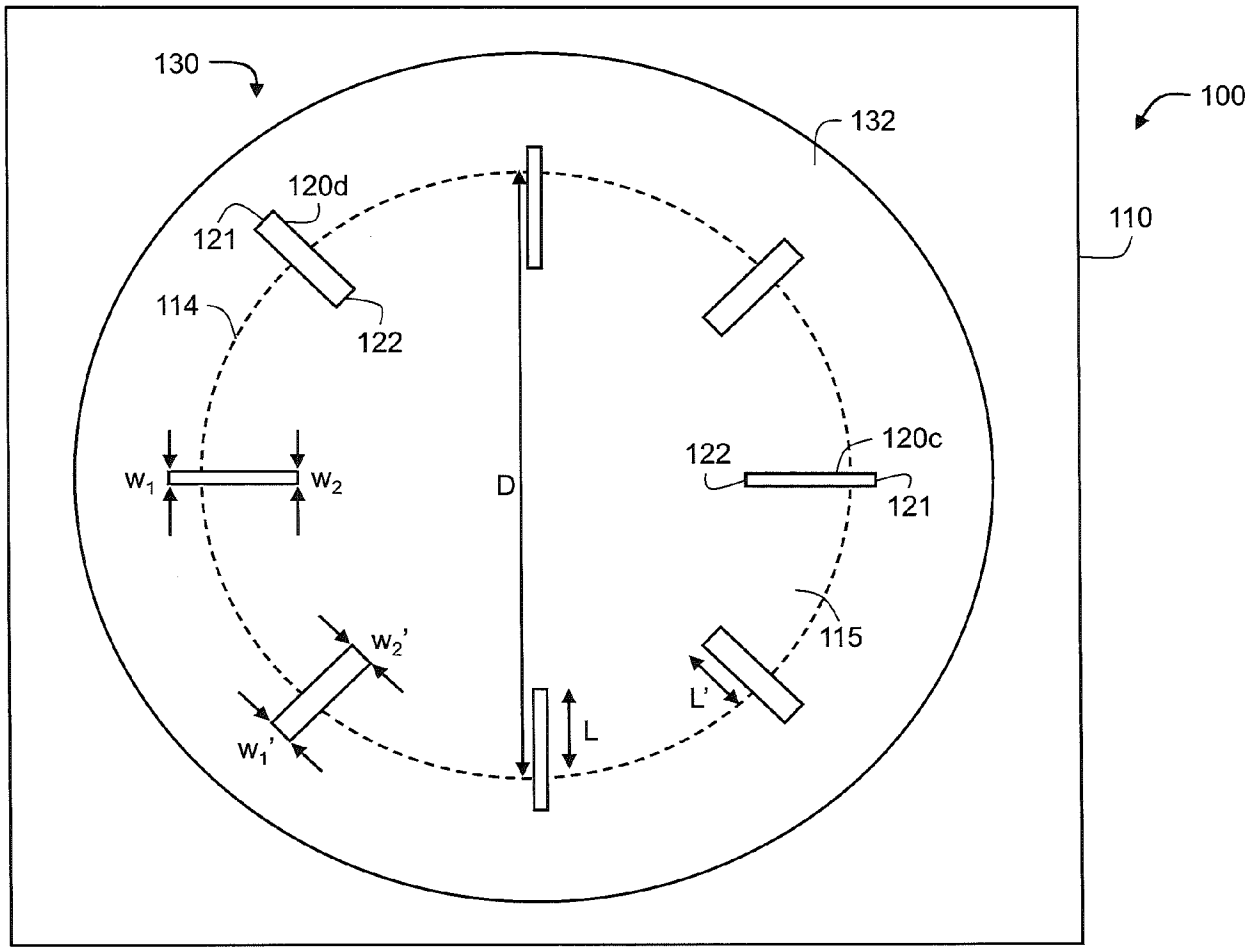
FIG. 6 is a top view of another embodiment including two different groups of cantilevered beams of different shapes.

FIG. 6 shows an embodiment similar to FIG. 5 in which there are two groups of cantilevered beams 120*c* and 120*d*, with the elements of the two groups being alternatingly arranged. In the embodiment of FIG. 6 however, the lengths L and L' of the cantilevered beams 120*c* and 120*d* respectively (the distances from anchored first ends 121 to free second ends 122) are less than 20% of the dimension D across cavity 115. In this particular example, where the outer boundary 114 of cavity 115 is circular, D is the diameter of the cavity 115. In addition, in the embodiment of FIG. 6, the lengths L and L' are different from each other, the first widths $w_1$ and $w_1'$ are different from each other, and the second widths $w_2$ and $w_2'$ are different from each other for the cantilevered beams 120*c* and 120*d*. Such an embodiment is beneficial when the groups of both geometries of cantilevered beams 120*c* and 120*d* are used to convert a motion of compliant membrane 130 to an electrical signal, and it is desired to pick up different amounts of deflection or at different frequencies (see equations 1, 2 and 3 in the background).

In the embodiments shown in FIGS. 1A and 3-6, the cantilevered beams 120 (one example of a MEMS transducing member) are disposed with substantially radial symmetry around a circular cavity 115. This can be a preferred type of configuration in many embodiments, but other embodiments are contemplated having nonradial symmetry or noncircular cavities. For embodiments including a plurality of MEMS transducing members as shown in FIGS. 3-6, the compliant membrane 130 across cavity 115 provides a degree of coupling between the MEMS transducing members. For example, the actuators discussed above relative to FIGS. 4 and 5 can cooperate to provide a larger combined force and a larger volumetric displacement of compliant membrane 130 when compared to a single actuator. The sensing elements (converting motion to an electrical signal) discussed above relative to FIGS. 5 and 6 can detect motion of different regions of the compliant membrane 130.

Figure 7:
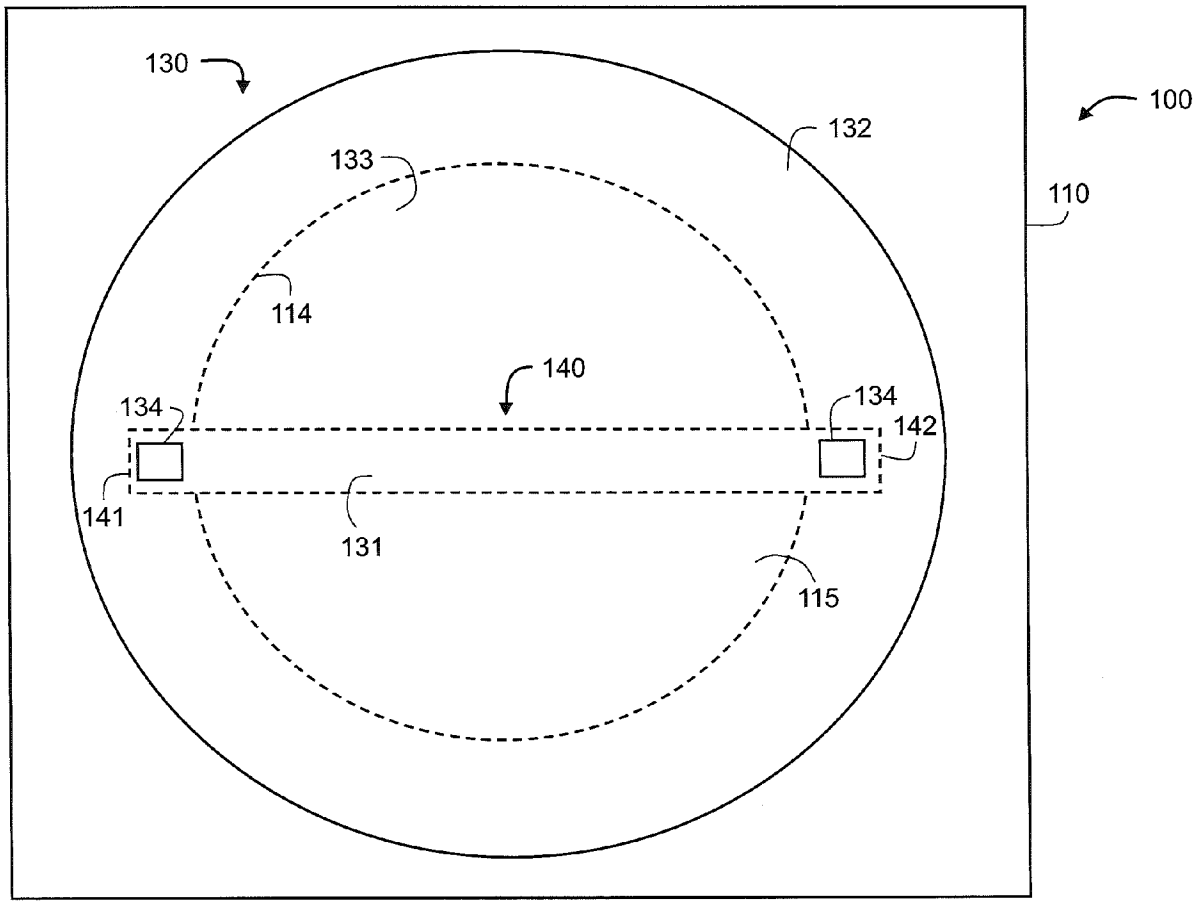
FIG. 7 is a top view of an embodiment where the MEMS composite transducer includes a doubly anchored beam and a compliant membrane.

FIG. 7 shows an embodiment of a MEMS composite transducer in a top view similar to FIG. 1A, but where the MEMS transducing member is a doubly anchored beam 140 extending across cavity 115 and having a first end 141 and a second end 142 that are each anchored to substrate 110. As in the embodiment of FIGS. 1A and 1B, compliant membrane 130 includes a first portion 131 that covers the MEMS transducing member, a second portion 132 that is anchored to first surface 111 of substrate 110, and a third portion 133 that overhangs cavity 115 while not contacting the MEMS transducing member. In the example of FIG. 7, a portion 134 of compliant membrane 130 is removed over both first end 141 and second end 142 in order to make electrical contact in order to pass a current from the first end 141 to the second end 142.

Figure 8A:
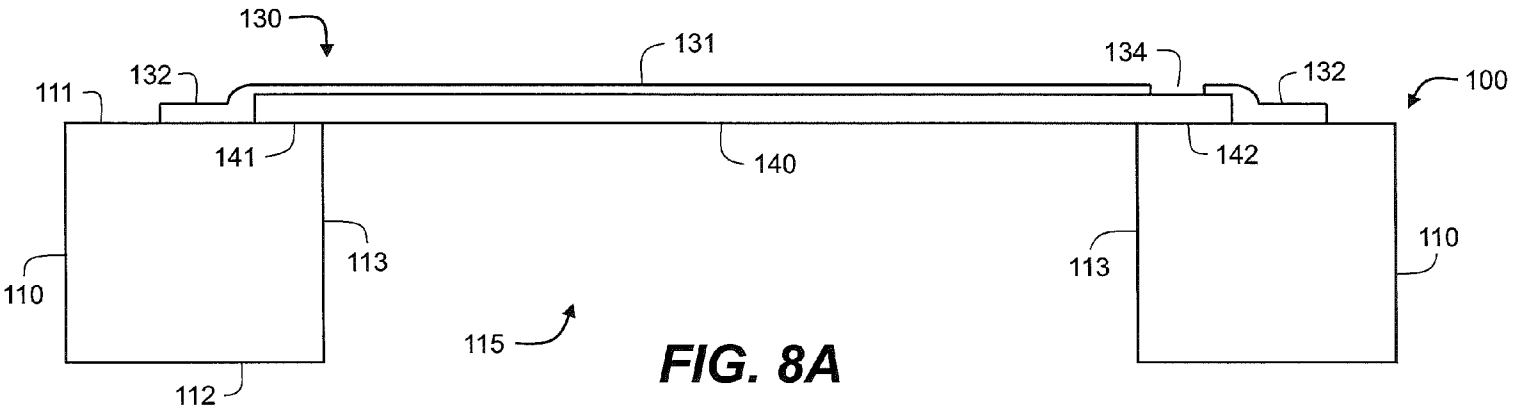
FIG. 8A is a cross-sectional view of the MEMS composite transducer of FIG. 7 in its undeflected state.

FIG. 8A shows a cross-sectional view of a doubly anchored beam 140 MEMS composite transducer in its undeflected state, similar to the cross-sectional view of the cantilevered beam 120 shown in FIG. 1B. In this example, a portion 134 of compliant membrane 130 is removed only at anchored second end 142 in order to make electrical contact on a top side of the MEMS transducing member to apply (or sense) a voltage across the MEMS transducing member as is discussed in further detail below. Similar to FIGS. 1A and 1B, the cavity 115 is substantially cylindrical and extends from a first surface 111 of substrate 110 to a second surface 112 that is opposite first surface 111.

Figure 8B:
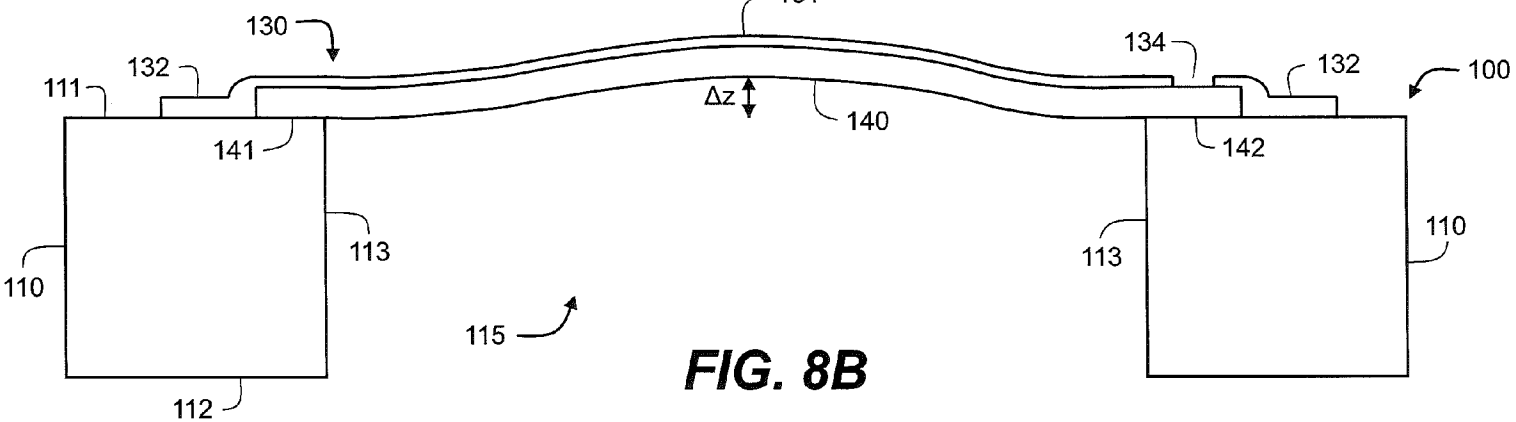
FIG. 8B is a cross-sectional view of the MEMS composite transducer of FIG. 7 in its deflected state.

FIG. 8B shows a cross-sectional view of the doubly anchored beam 140 in its deflected state, similar to the cross-sectional view of the cantilevered beam 120 shown in FIG. 2. The portion of doubly anchored beam 140 extending across cavity 115 is deflected up and away from the undeflected position of FIG. 8A, so that it raises up the portion 131 of compliant membrane 130. The maximum deflection at or near the middle of doubly anchored beam 140 is shown as $\delta=\Delta z$.

Figure 9:
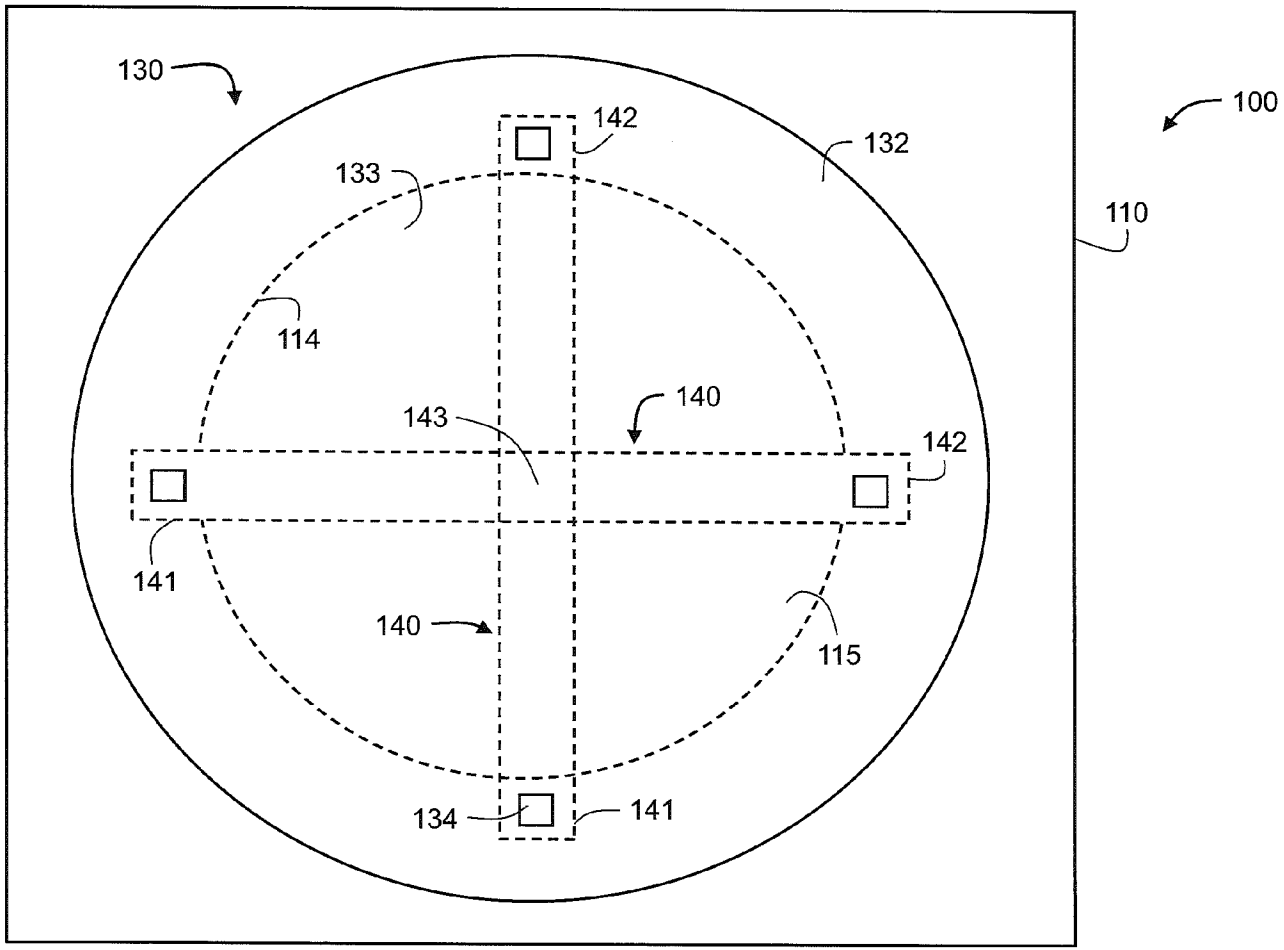
FIG. 9 is a top view of an embodiment where the MEMS composite transducer includes two intersecting doubly anchored beams and a compliant membrane.

FIG. 9 shows a top view of an embodiment similar to that of FIG. 7, but with a plurality (for example, two) of doubly anchored beams 140 anchored to the substrate 110 at their first end 141 and second end 142. In this embodiment both doubly anchored beams 140 are disposed substantially radially across circular cavity 115, and therefore the two doubly anchored beams 140 intersect each other over the cavity at an intersection region 143. Other embodiments are contemplated in which a plurality of doubly anchored beams do not intersect each other or the cavity is not circular. For example, two doubly anchored beams can be parallel to each other and extend across a rectangular cavity.

Figure 10:
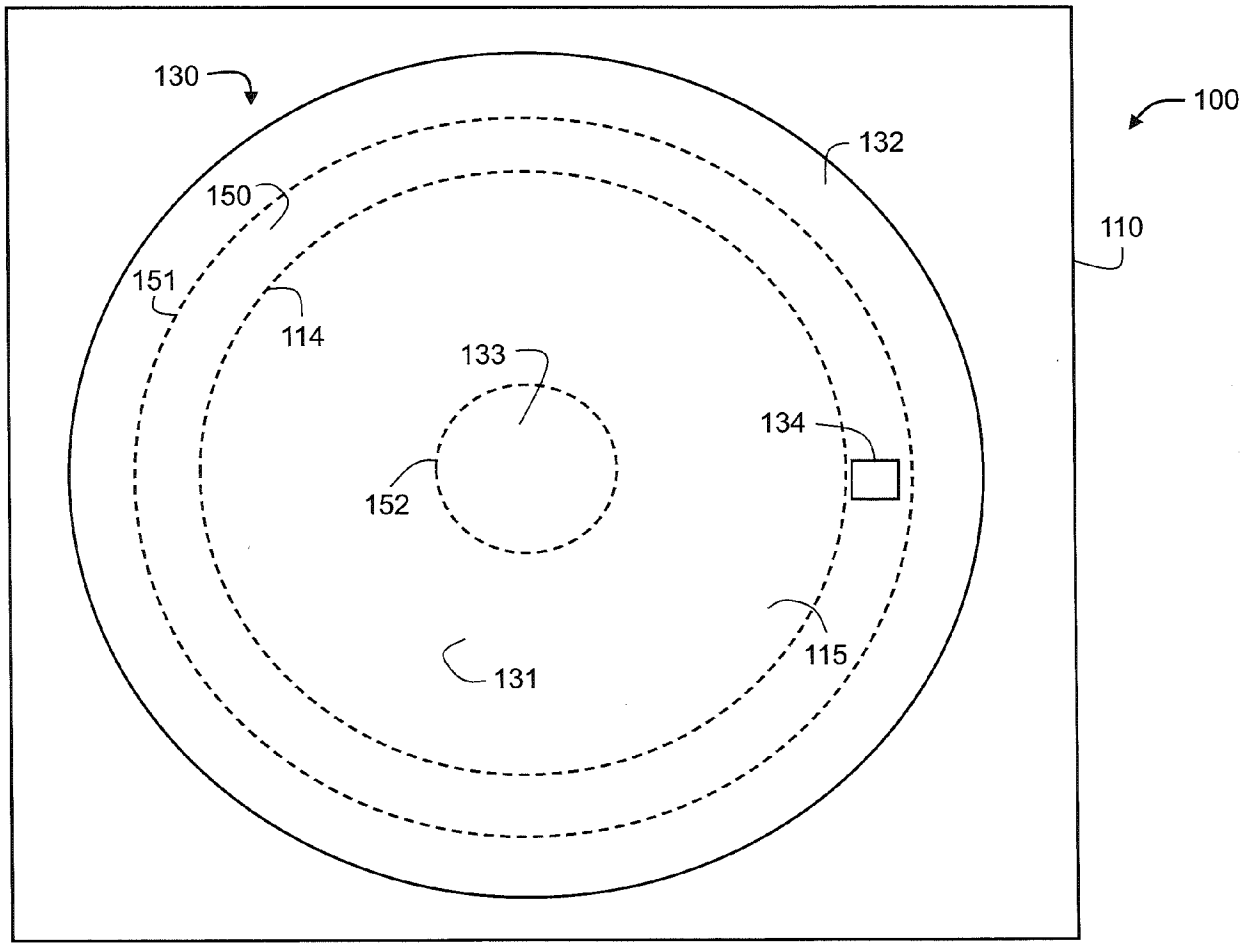
FIG. 10 is a top view of an embodiment where the MEMS composite transducer includes a clamped sheet and a compliant membrane.

FIG. 10 shows an embodiment of a MEMS composite transducer in a top view similar to FIG. 1A, but where the MEMS transducing member is a clamped sheet 150 extending across a portion of cavity 115 and anchored to the substrate 110 around the outer boundary 114 of cavity 115. Clamped sheet 150 has a circular outer boundary 151 and a circular inner boundary 152, so that it has an annular shape. As in the embodiment of FIGS. 1 and 1B, compliant membrane 130 includes a first portion 131 that covers the MEMS transducing member, a second portion 132 that is anchored to first surface 111 of substrate 110, and a third portion 133 that overhangs cavity 115 while not contacting the MEMS transducing member. In a fourth region 134, compliant membrane 130 is removed such that it does not cover a portion of the MEMS transducing member, so that electrical contact can be made as is discussed in further detail below.

Figure 11A:
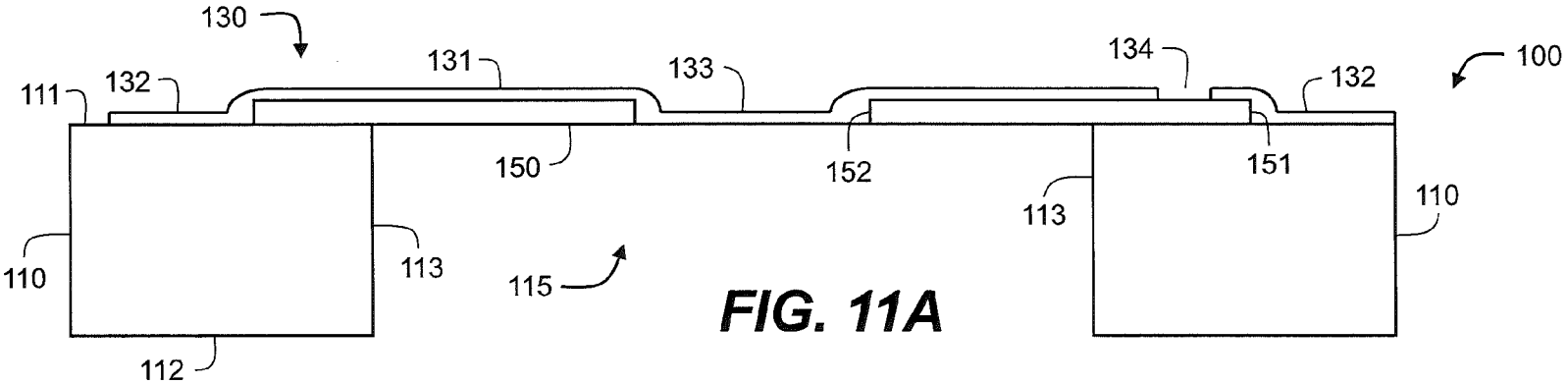
FIG. 11A is a cross-sectional view of the MEMS composite transducer of FIG. 10 in its undeflected state.

FIG. 11A shows a cross-sectional view of a clamped sheet 150 MEMS composite transducer in its undeflected state, similar to the cross-sectional view of the cantilevered beam 120 shown in FIG. 1B. Similar to FIGS. 1A and 1B, the cavity 115 is substantially cylindrical and extends from a first surface 111 of substrate 110 to a second surface 112 that is opposite first surface 111.

Figure 11B:
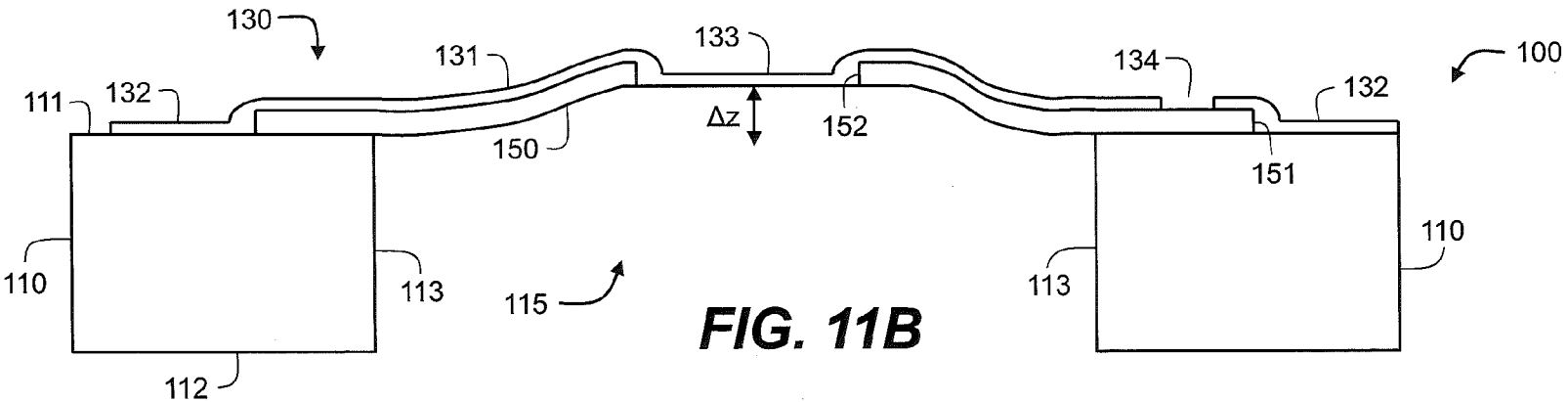
FIG. 11B is a cross-sectional view of the MEMS composite transducer of FIG. 10 in its deflected state.

FIG. 11B shows a cross-sectional view of the clamped sheet 150 in its deflected state, similar to the cross-sectional view of the cantilevered beam 120 shown in FIG. 2. The portion of clamped sheet 150 extending across cavity 115 is deflected up and away from the undeflected position of FIG. 11A, so that it raises up the portion 131 of compliant membrane 130, as well as the portion 133 that is inside inner boundary 152. The maximum deflection at or near the inner boundary 152 is shown as $\delta=\Delta z$.

Figure 12A:
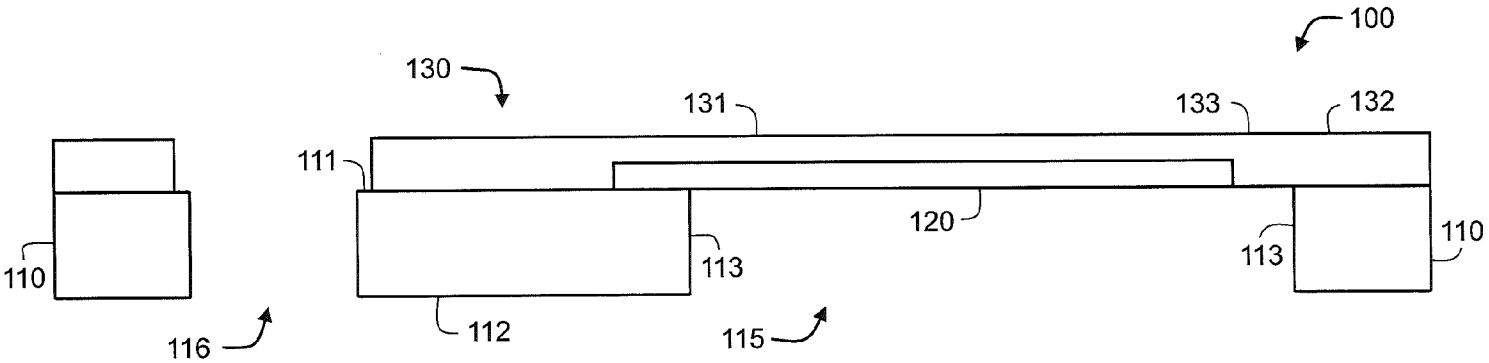
FIG. 12A is a cross-sectional view of an embodiment similar to that of FIG. 1A, but also including an additional through hole in the substrate.

FIG. 12A shows a cross sectional view of an embodiment of a composite MEMS transducer having a cantilevered beam 120 extending across a portion of cavity 115, where the cavity is a through hole from second surface 112 to first surface 111 of substrate 110. As in the embodiment of FIGS. 1 and 1B, compliant membrane 130 includes a first portion 131 that covers the MEMS transducing member, a second portion 132 that is anchored to first surface 111 of substrate 110, and a third portion 133 that overhangs cavity 115 while not contacting the MEMS transducing member. Additionally in the embodiment of FIG. 12A, the substrate further includes a second through hole 116 from second surface 112 to first surface 111 of substrate 110, where the second through hole 116 is located near cavity 115. In the example shown in FIG. 12A, no MEMS transducing member extends over the second through hole 116. In other embodiments where there is an array of composite MEMS transducers formed on substrate 110, the second through hole 116 can be the cavity of an adjacent MEMS composite transducer.

Figure 12B:
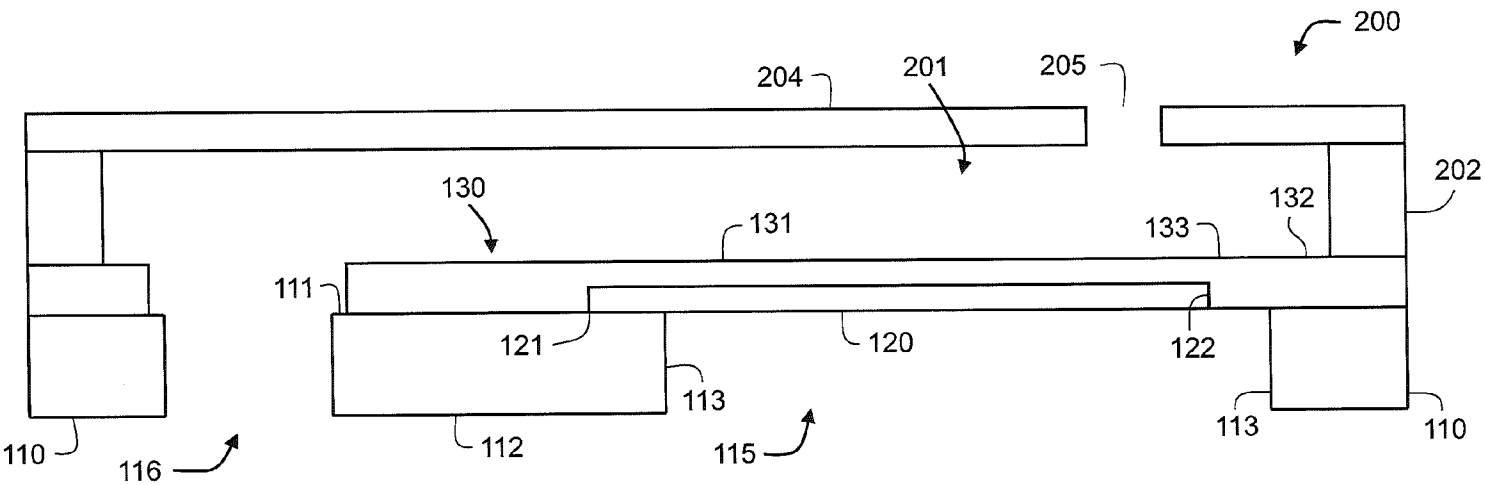
FIG. 12B is a cross-sectional view of a fluid ejector that incorporates the structure shown in FIG. 12A.

The configuration shown in FIG. 12A can be used in a fluid ejector 200 as shown in FIG. 12B. In FIG. 12B, partitioning walls 202 are formed over the anchored portion 132 of compliant membrane 130. In other embodiments (not shown), partitioning walls 202 are formed on first surface 111 of substrate 110 in a region where compliant membrane 130 has been removed. Partitioning walls 202 define a chamber 201. A nozzle plate 204 is formed over the partitioning walls and includes a nozzle 205 disposed near second end 122 of the cantilevered beam 120. Through hole 116 is a fluid feed that is fluidically connected to chamber 201, but not fluidically connected to cavity 115. Fluid is provided to cavity 201 through the fluid feed (through hole 116). When an electrical signal is provided to the MEMS transducing member (cantilevered beam 120) at an electrical connection region (not shown), second end 122 of cantilevered beam 120 and a portion of compliant membrane 130 are deflected upward and away from cavity 115 (as shown in FIG. 2), so that a drop of fluid is ejected through nozzle 205.

Figure 13:
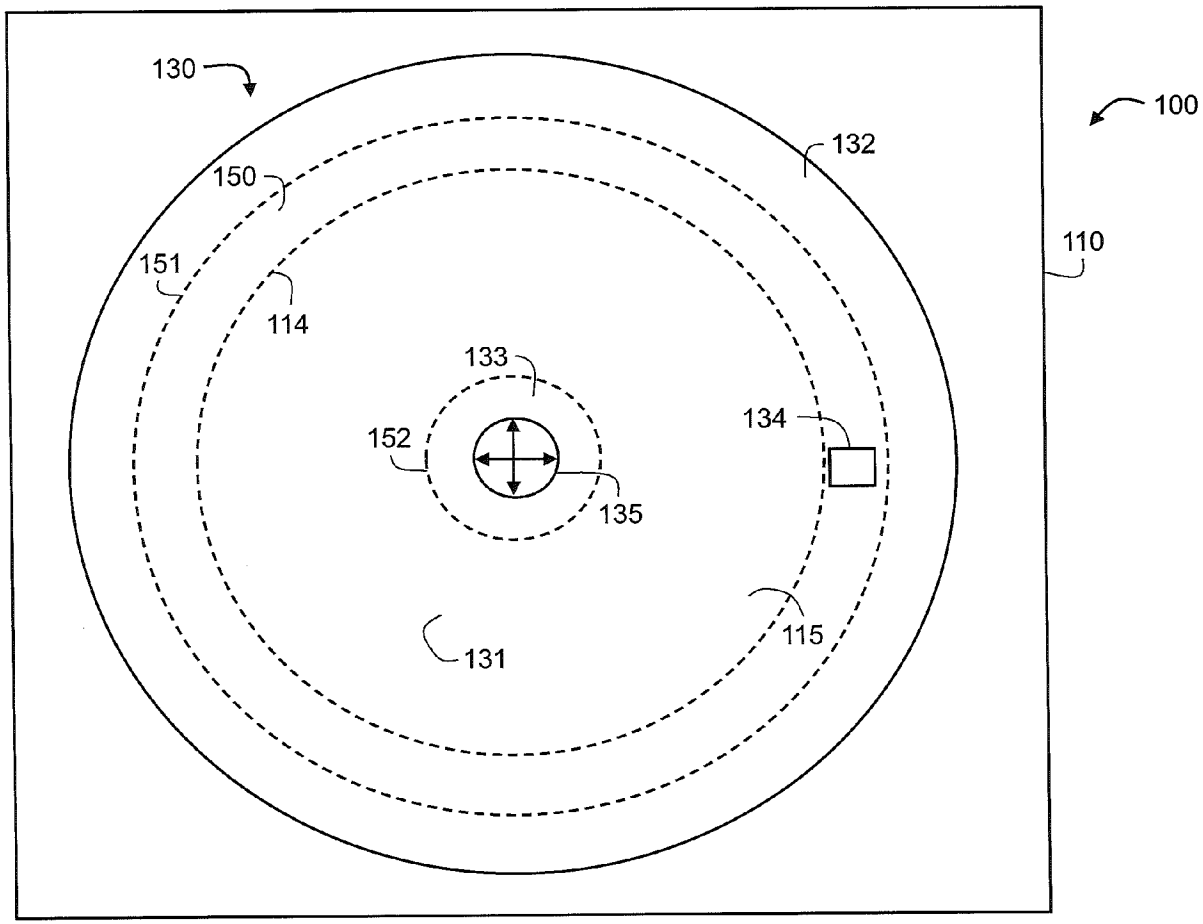
FIG. 13 is a top view of an embodiment similar to that of FIG. 10, but where the compliant membrane also includes a hole.
Figure 14:
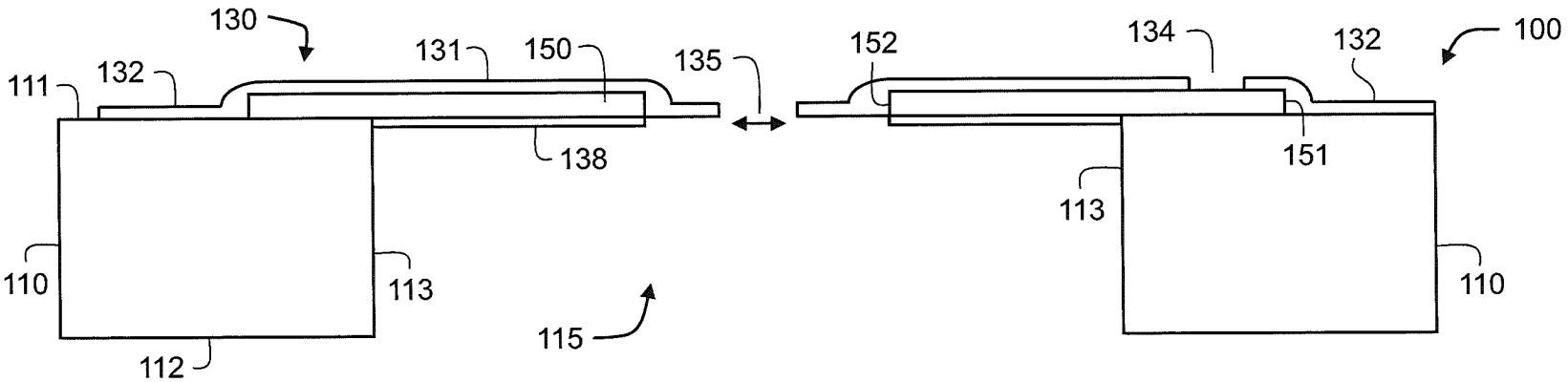
FIG. 14 is a cross-sectional view of the embodiment shown in FIG. 13.

The embodiment shown in FIG. 13 is similar to the embodiment of FIG. 10, where the MEMS transducing member is a clamped sheet 150, but in addition, compliant membrane 130 includes a hole 135 at or near the center of cavity 115. As also illustrated in FIG. 14, the MEMS composite transducer is disposed along a plane, and at least a portion of the MEMS composite transducer is movable within the plane. In particular, the clamped sheet 150 in FIGS. 13 and 14 is configured to expand and contract radially, causing the hole 135 to expand and contract, as indicated by the double-headed arrows. Such an embodiment can be used in a drop generator for a continuous fluid jetting device, where a pressurized fluid source is provided to cavity 115, and the hole 135 is a nozzle. The expansion and contraction of hole 135 stimulates the controllable break-off of the stream of fluid into droplets. Optionally, a compliant passivation material 138 can be formed on the side of the MEMS transducing material that is opposite the side that the portion 131 of compliant membrane 130 is formed on. Compliant passivation material 138 together with portion 131 of compliant membrane 130 provide a degree of isolation of the MEMS transducing member (clamped sheet 150) from the fluid being directed through cavity 115.

Figure 15:
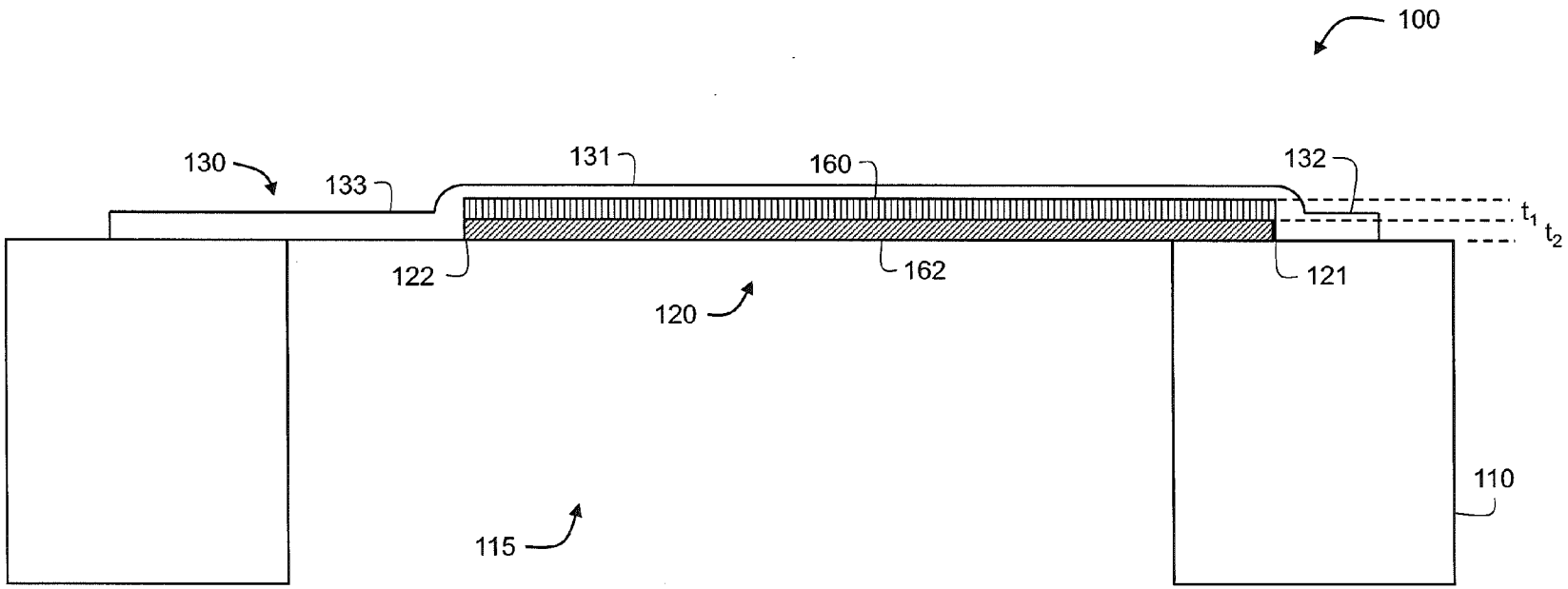
FIG. 15 is a cross-sectional view showing additional structural detail of an embodiment of a MEMS composite transducer including a cantilevered beam.

A variety of transducing mechanisms and materials can be used in the MEMS composite transducer of the present invention. Some of the MEMS transducing mechanisms include a deflection out of the plane of the undeflected MEMS composite transducer that includes a bending motion as shown in FIGS. 2, 8B and 11B. A transducing mechanism including bending is typically provided by a MEMS transducing material 160 in contact with a reference material 162, as shown for the cantilevered beam 120 in FIG. 15. In the example of FIG.

15, the MEMS transducing material 160 is shown on top of reference material 162, but alternatively the reference material 162 can be on top of the MEMS transducing material 160, depending upon whether it is desired to cause bending of the MEMS transducing member (for example, cantilevered beam 120) into the cavity 115 or away from the cavity 115, and whether the MEMS transducing material 160 is caused to expand more than or less than an expansion of the reference material 162.

One example of a MEMS transducing material 160 is the high thermal expansion member of a thermally bending bimorph. Titanium aluminide can be the high thermal expansion member, for example, as disclosed in commonly assigned U.S. Pat. No. 6,561,627. The reference material 162 can include an insulator such as silicon oxide, or silicon oxide plus silicon nitride. When a current pulse is passed through the titanium aluminide MEMS transducing material 160, it causes the titanium aluminide to heat up and expand. The reference material 160 is not self-heating and its thermal expansion coefficient is less than that of titanium aluminide, so that the titanium aluminide MEMS transducing material 160 expands at a faster rate than the reference material 162. As a result, a cantilever beam 120 configured as in FIG. 15 would tend to bend downward into cavity 115 as the MEMS transducing material 160 is heated. Dual-action thermally bending actuators can include two MEMS transducing layers (deflector layers) of titanium aluminide and a reference material layer sandwiched between, as described in commonly assigned U.S. Pat. No. 6,464,347. Deflections into the cavity 115 or out of the cavity can be selectively actuated by passing a current pulse through either the upper deflector layer or the lower deflector layer respectively.

A second example of a MEMS transducing material 160 is a shape memory alloy such as a nickel titanium alloy. Similar to the example of the thermally bending bimorph, the reference material 162 can be an insulator such as silicon oxide, or silicon oxide plus silicon nitride. When a current pulse is passed through the nickel titanium MEMS transducing material 160, it causes the nickel titanium to heat up. A property of a shape memory alloy is that a large deformation occurs when the shape memory alloy passes through a phase transition. If the deformation is an expansion, such a deformation would cause a large and abrupt expansion while the reference material 162 does not expand appreciably. As a result, a cantilever beam 120 configured as in FIG. 15 would tend to bend downward into cavity 115 as the shape memory alloy MEMS transducing material 160 passes through its phase transition. The deflection would be more abrupt than for the thermally bending bimorph described above.

A third example of a MEMS transducing material 160 is a piezoelectric material. Piezoelectric materials are particularly advantageous, as they can be used as either actuators or sensors. In other words, a voltage applied across the piezoelectric MEMS transducing material 160, typically applied to conductive electrodes (not shown) on the two sides of the piezoelectric MEMS transducing material, can cause an expansion or a contraction (depending upon whether the voltage is positive or negative and whether the sign of the piezoelectric coefficient is positive or negative). While the voltage applied across the piezoelectric MEMS transducing material 160 causes an expansion or contraction, the reference material 162 does not expand or contract, thereby causing a deflection into the cavity 115 or away from the cavity 115 respectively. Typically in a piezoelectric composite MEMS transducer, a single polarity of electrical signal would be applied however, so that the piezoelectric material does not tend to become depoled. It is possible to sandwich a reference material 162 between two piezoelectric material layers, thereby enabling separate control of deflection into cavity 115 or away from cavity 115 without depoling the piezoelectric material. Furthermore, an expansion or contraction imparted to the MEMS transducing material 160 produces an electrical signal which can be used to sense motion. There are a variety of types of piezoelectric materials. One family of interest includes piezoelectric ceramics, such as lead zirconate titanate or PZT.

As the MEMS transducing material 160 expands or contracts, there is a component of motion within the plane of the MEMS composite transducer, and there is a component of motion out of the plane (such as bending). Bending motion (as in FIGS. 2, 8B and 11B) will be dominant if the Young's modulus and thickness of the MEMS transducing material 160 and the reference material 162 are comparable. In other words, if the MEMS transducing material 160 has a thickness $t_1$ and if the reference material has a thickness $t_2$, then bending motion will tend to dominate if $t_2>0.5t_1$ and $t_2<2t_1$, assuming comparable Young's moduli. By contrast, if $t_2<0.2t_1$, motion within the plane of the MEMS composite transducer (as in FIGS. 13 and 14) will tend to dominate.

Figure 16A:
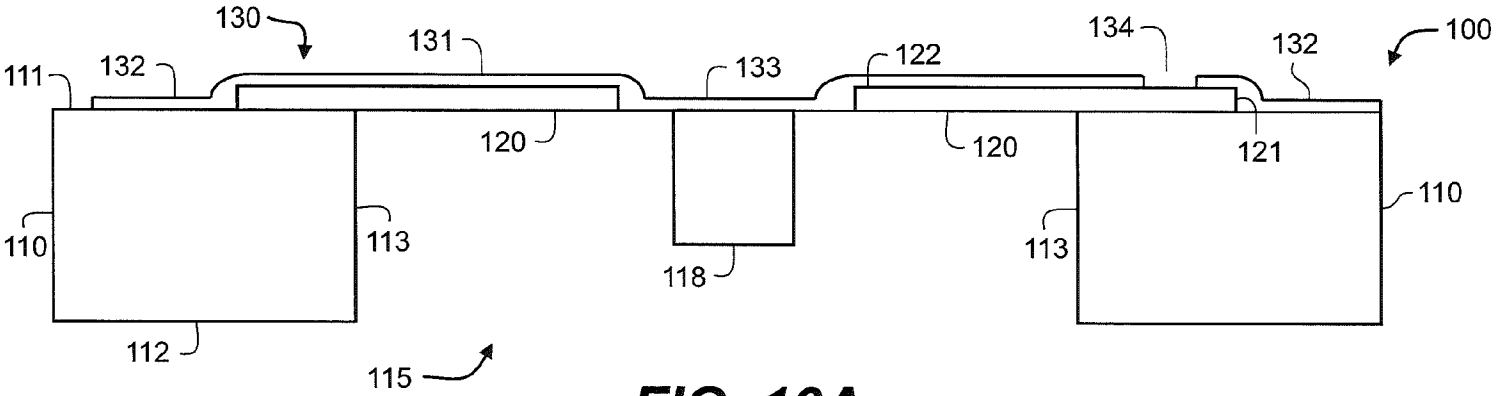
FIG. 16A is a cross-sectional view of an embodiment similar to that of FIG. 6, but also including an attached mass that extends into the cavity.
Figure 16B:
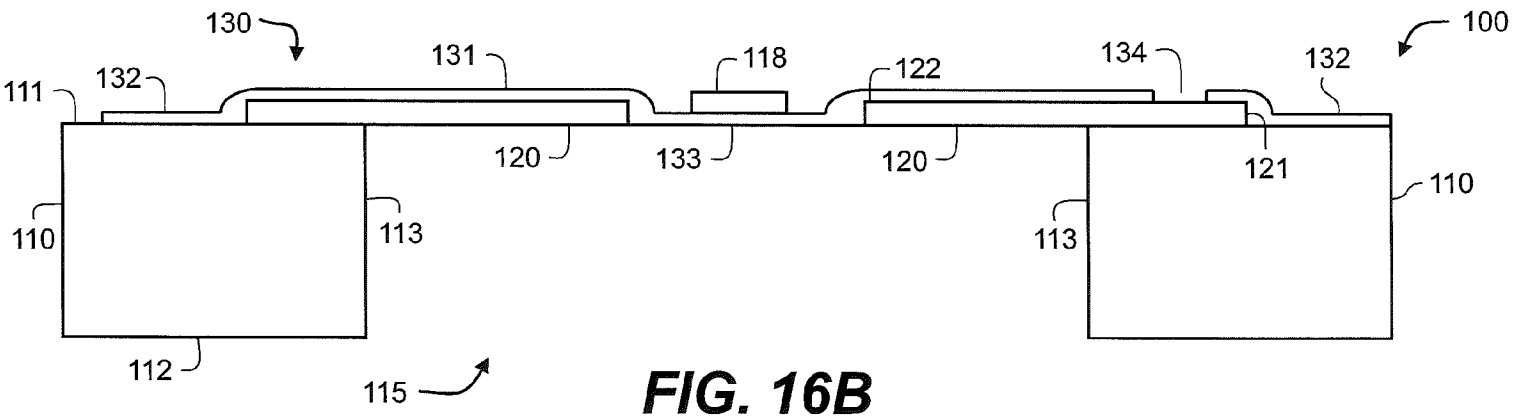
FIG. 16B is a cross-sectional view of an embodiment similar to that of FIG. 16A, but where the attached mass is on the opposite side of the compliant membrane.

Some embodiments of MEMS composite transducer 100 include an attached mass, in order to adjust the resonant frequency for example (see equation 2 in the background). The mass 118 can be attached to the portion 133 of the compliant membrane 130 that overhangs cavity 115 but does not contact the MEMS transducing member, for example. In the embodiment shown in the cross-sectional view of FIG. 16A including a plurality of cantilevered beams 120 (such as the configuration shown in FIG. 6), mass 118 extends below portion 133 of compliant membrane 130, so that it is located within the cavity 115. Alternatively, mass 118 can be affixed to the opposite side of the compliant membrane 130, as shown in FIG. 16B. The configuration of FIG. 16A can be particularly advantageous if a large mass is needed. For example, a portion of silicon substrate 110 can be left in place when cavity 115 is etched as described below. In such a configuration, mass 118 would typically extend the full depth of the cavity. In order for the MEMS composite transducer to vibrate without crashing of mass 118, substrate 110 would typically be mounted on a mounting member (not shown) including a recess below cavity 115. For the configuration shown in FIG. 16B, the attached mass 118 can be formed by patterning an additional layer over the compliant membrane 130.

Figure 17A:
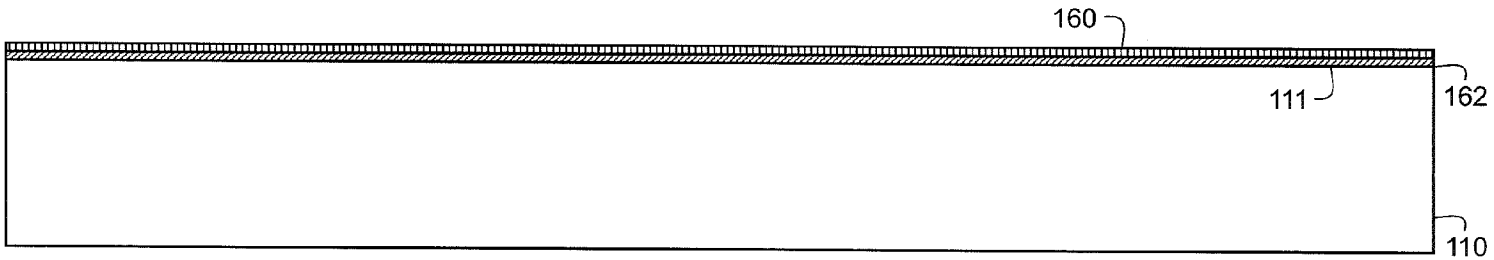
FIGS. 17A to 17E illustrate an overview of a method of fabrication.
Figure 17B:
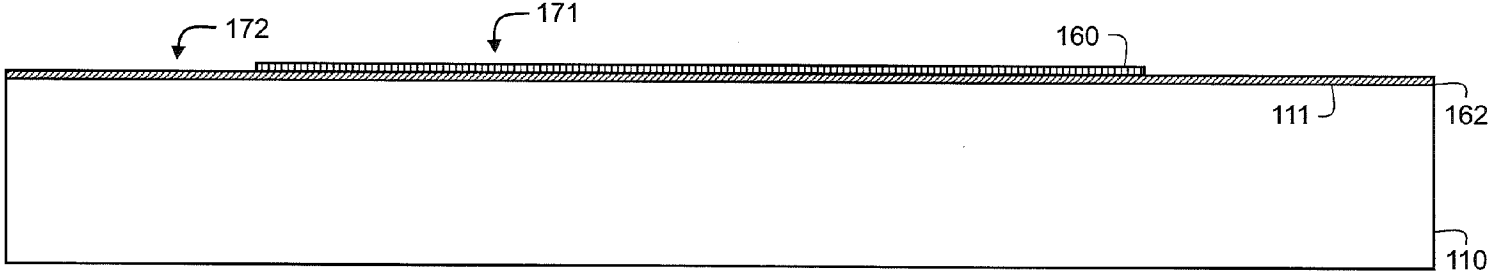
Figure 17C:
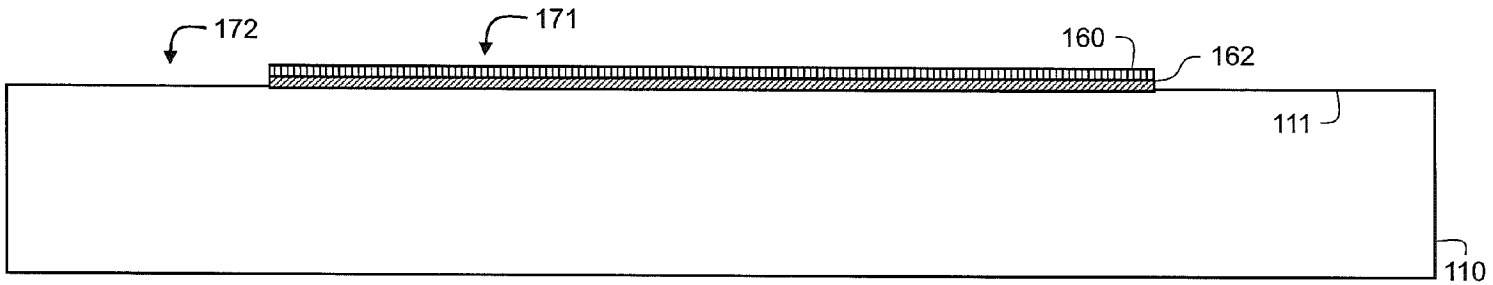

Having described a variety of exemplary structural embodiments of MEMS composite transducers, a context has been provided for describing methods of fabrication. FIGS. 17A to 17E provide an overview of a method of fabrication. As shown in FIG. 17A, a reference material 162 and a transducing material 160 are deposited over a first surface 111 of a substrate 110, which is typically a silicon wafer. Further details regarding materials and deposition methods are provided below. The reference material 162 can be deposited first (as in FIG. 17A) followed by deposition of the transducing material 160, or the order can be reversed. In some instances, a reference material might not be required. In any case, it can be said that the transducing material 160 is deposited over the first surface 111 of substrate 110. The transducing material 160 is then patterned and etched, so that transducing material 160 is retained in a first region 171 and removed in a second region 172 as shown in FIG. 17B. The reference material 162 is also patterned and etched, so that it is retained in first region 171 and removed in second region 172 as shown in FIG. 17C.

Figure 17D:
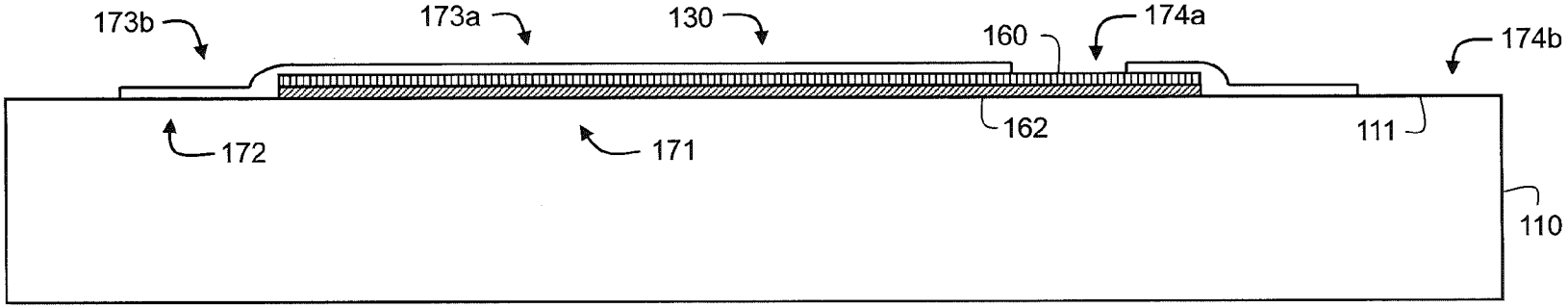
Figure 17E:
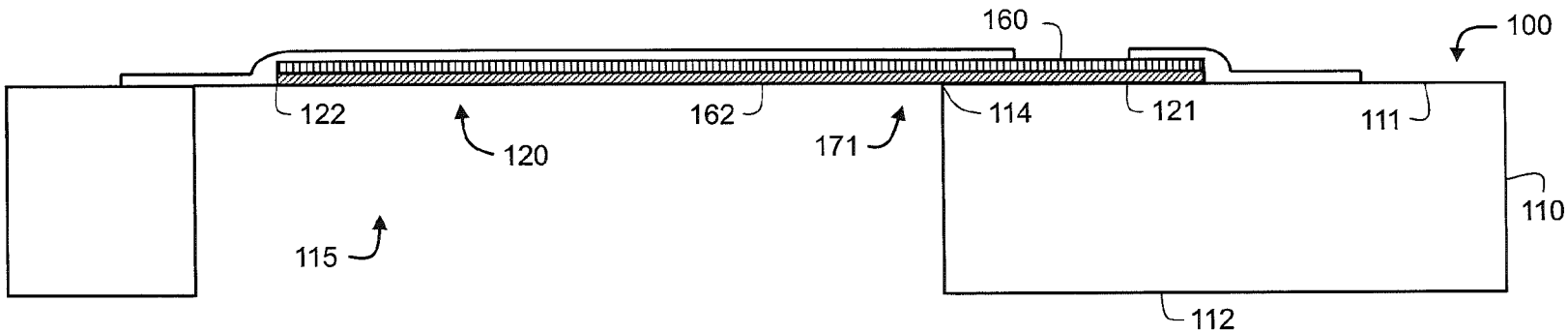

As shown in FIG. 17D, a polymer layer (for compliant membrane 130) is then deposited over the first and second regions 171 and 172, and patterned such that polymer is retained in a third region 173 and removed in a fourth region 174. A first portion 173*a* where polymer is retained is coincident with a portion of first region 171 where transducing material 160 is retained. A second portion 173*b* where polymer is retained is coincident with a portion of second region 172 where transducing material 160 is removed. In addition, a first portion 174*a* where polymer is removed is coincident with a portion of first region 171 where transducing material 160 is retained. A second portion 174*b* where polymer is removed is coincident with a portion of second region 172 where transducing material 160 is removed. A cavity 115 is then etched from a second surface 112 (opposite first surface 111) to first surface 111 of substrate 110, such that an outer boundary 114 of cavity 115 at the first surface 111 of substrate 110 intersects the first region 171 where transducing material 160 is retained, so that a first portion of transducing material 160 (including first end 121 of cantilevered beam 120 in this example) is anchored to first surface 111 of substrate 110, and a second portion of transducing material 160 (including second end 122 of cantilevered beam 120) extends over at least a portion of cavity 115. When it is said that a first portion of transducing material 160 is anchored to first surface 111 of substrate 110, it is understood that transducing material 160 can be in direct contact (not shown) with first surface 111, or transducing material 160 can be indirectly anchored to first surface 111 through reference material 162 as shown in FIG. 17E. A MEMS composite transducer 100 is thereby fabricated.

Figure 18A:
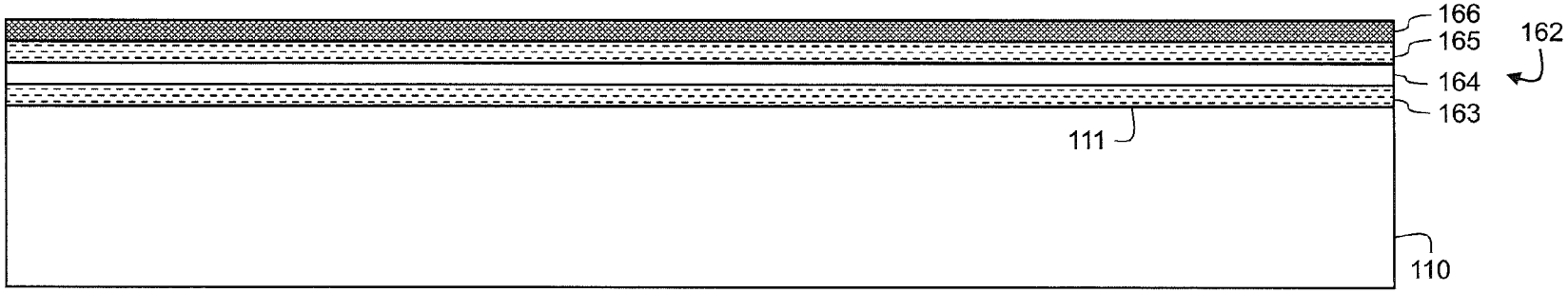
FIGS. 18A and 18B provide addition details of layers that can be part of the MEMS composite transducer.

Reference material 162 can include several layers as illustrated in FIG. 18A. A first layer 163 of silicon oxide can be deposited on first surface 111 of substrate 110. Deposition of silicon oxide can be a thermal process or it can be chemical vapor deposition (including low pressure or plasma enhanced CVD) for example. Silicon oxide is an insulating layer and also facilitates adhesion of the second layer 164 of silicon nitride. Silicon nitride can be deposited by LPCVD and provides a tensile stress component that will help the transducing material 160 to retain a substantially flat shape when the cavity is subsequently etched away. A third layer 165 of silicon oxide helps to balance the stress and facilitates adhesion of an optional bottom electrode layer 166, which is typically a platinum (or titanium/platinum) electrode for the case of a piezoelectric transducing material 160. The platinum electrode layer is typically deposited by sputtering.

Figure 18B:
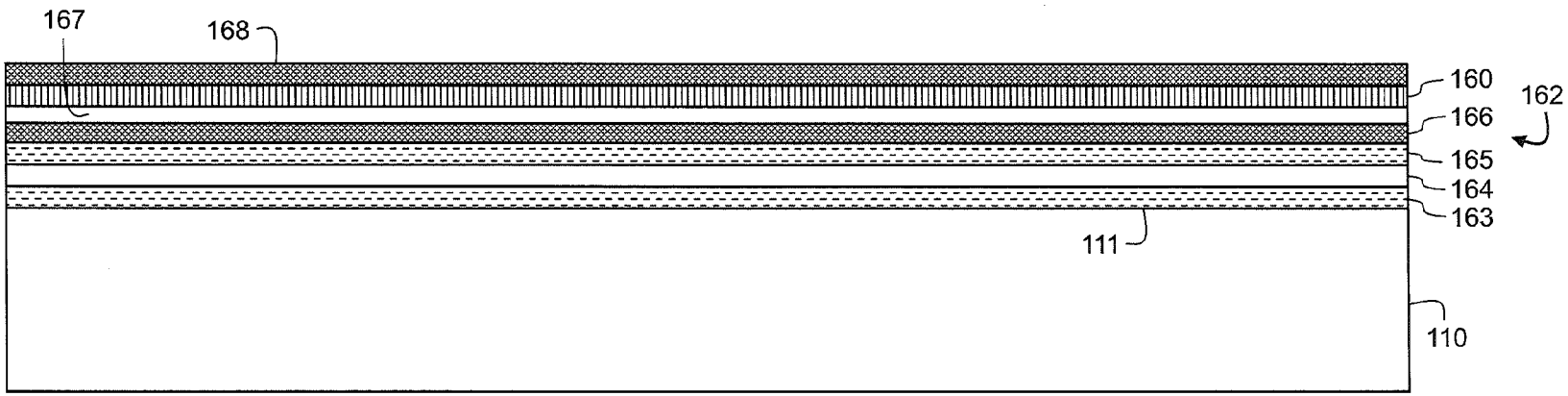

Deposition of the transducing material 160 will next be described for the case of a piezoelectric ceramic transducing material, such as PZT. An advantageous configuration is the one shown in FIG. 18B in which a voltage is applied across PZT transducing material 160 from a top electrode 168 to a bottom electrode 166. The desired effect on PZT transducing material 160 is an expansion or contraction along the x-y plane parallel to surface 111 of substrate 110. As described above, such an expansion or contraction can cause a deflection into the cavity 115 or out of the cavity 115 respectively, or a substantially in-plane motion, depending on the relative thicknesses and stiffnesses of the PZT transducing material 160 and the reference material 162. Thicknesses are not to scale in FIGS. 18A and 18B. Typically for a bending application where the reference material 162 has a comparable stiffness to the MEMS transducing material 160, the reference material 162 is deposited in a thickness of about 1 micron, as is the transducing material 160, although for in-plane motion the reference material thickness is typically 20% or less of the transducing material thickness, as described above. The transverse piezoelectric coefficients $d_{31}$ and $e_{31}$ are relatively large in magnitude for PZT (and can be made to be larger and stabilized if poled in a relatively high electric field). To orient the PZT crystals such that transverse piezoelectric coefficients $d_{31}$ and $e_{31}$ are the coefficients relating voltage across the transducing layer and expansion or contraction in the x-y plane, it is desired that the (001) planes of the PZT crystals be parallel to the x-y plane (parallel to the bottom platinum electrode layer 166 as shown in FIG. 18B). However, PZT material will tend to orient with its planes parallel to the planes of the material upon which it is deposited. Because the platinum bottom electrode layer 166 typically has its (111) planes parallel to the x-y plane when deposited on silicon oxide, a seed layer 167, such as lead oxide or lead titanate can be deposited over bottom electrode layer 166 in order to provide the (001) planes on which to deposit the PZT transducing material 160. Then the upper electrode layer 168 (typically platinum) is deposited over the PZT transducing material 160, e.g. by sputtering.

Deposition of the PZT transducing material 160 can be done by sputtering. Alternatively, deposition of the PZT transducing material 160 can be done by a sol-gel process. In the sol-gel process, a precursor material including PZT particles in an organic liquid is applied over first surface 111 of substrate 110. For example, the precursor material can be applied over first surface 111 by spinning the substrate 110. The precursor material is then heat treated in a number of steps. In a first step, the precursor material is dried at a first temperature. Then the precursor material is pyrolyzed at a second temperature higher than the first temperature in order to decompose organic components. Then the PZT particles of the precursor material are crystallized at a third temperature higher than the second temperature. PZT deposited by a sol-gel process is typically done using a plurality of thin layers of precursor material in order to avoid cracking in the material of the desired final thickness.

For embodiments where the transducing material 160 is titanium aluminide for a thermally bending actuator, or a shape memory alloy such as a nickel titanium alloy, deposition can be done by sputtering. In addition, layers such as the top and bottom electrode layers 166 and 168, as well as seed layer 167 are not required.

In order to pattern the stack of materials shown in FIGS. 18A and 18B, a photoresist mask is typically deposited over the top electrode layer 168 and patterned to cover only those regions where it is desired for material to remain. Then at least some of the material layers are etched at one time. For example, plasma etching using a chlorine based process gas can be used to etch the top electrode layer 168, the PZT transducing material 160, the seed layer 167 and the bottom electrode layer 166 in a single step. Alternatively the single step can include wet etching. Depending on materials, the rest of the reference material 162 can be etched in the single step. However, in some embodiments, the silicon oxide layers 163 and 165 and the silicon nitride layer 164 can be etched in a subsequent plasma etching step using a fluorine based process gas.

Depositing the polymer layer for compliant membrane 130 can be done by laminating a film, such as TMMF, or spinning on a liquid resist material, such as TMMR, as referred to above. As the polymer layer for the compliant membrane is applied while the transducers are still supported by the substrate, pressure can be used to apply the TMMF or other laminating film to the structure without risk of breaking the transducer beams. An advantage of TMMR and TMMF is that they are photopatternable, so that application of an additional resist material is not required. An epoxy polymer further has desirable mechanical properties as mentioned above.

In order to etch cavity 115 (FIG. 17E) a masking layer is applied to second surface 112 of substrate 110. The masking layer is patterned to expose second surface 112 where it is desired to remove substrate material. The exposed portion can include not only the region of cavity 115, but also the region of through hole 116 of fluid ejector 200 (see FIGS. 12A and 12B). For the case of leaving a mass affixed to the bottom of the compliant membrane 130, as discussed above relative to FIG. 16A, the region of cavity 115 can be masked with a ring pattern to remove a ring-shaped region, while leaving a portion of substrate 110 attached to compliant membrane 130. For embodiments where substrate 110 is silicon, etching of substantially vertical walls (portions 113 of substrate 110, as shown in a number of the cross-sectional views including FIG. 1B) is readily done using a deep reactive ion etching (DRIE) process. Typically, a DRIE process for silicon uses $SF_6$ as a process gas.

As described above, one application for which MEMS composite transducer 100 is particularly well suited is as a drop generator (also commonly referred to as a drop forming mechanism). Example embodiments of flow-through liquid dispensers 310 that incorporate the drop generator described above are described in more detail below with reference to FIGS. 19A-26B and back to FIGS. 1A-2. These types of liquid dispensers are also commonly referred to as continuous-on-demand liquid dispensers.

Figure 19A:
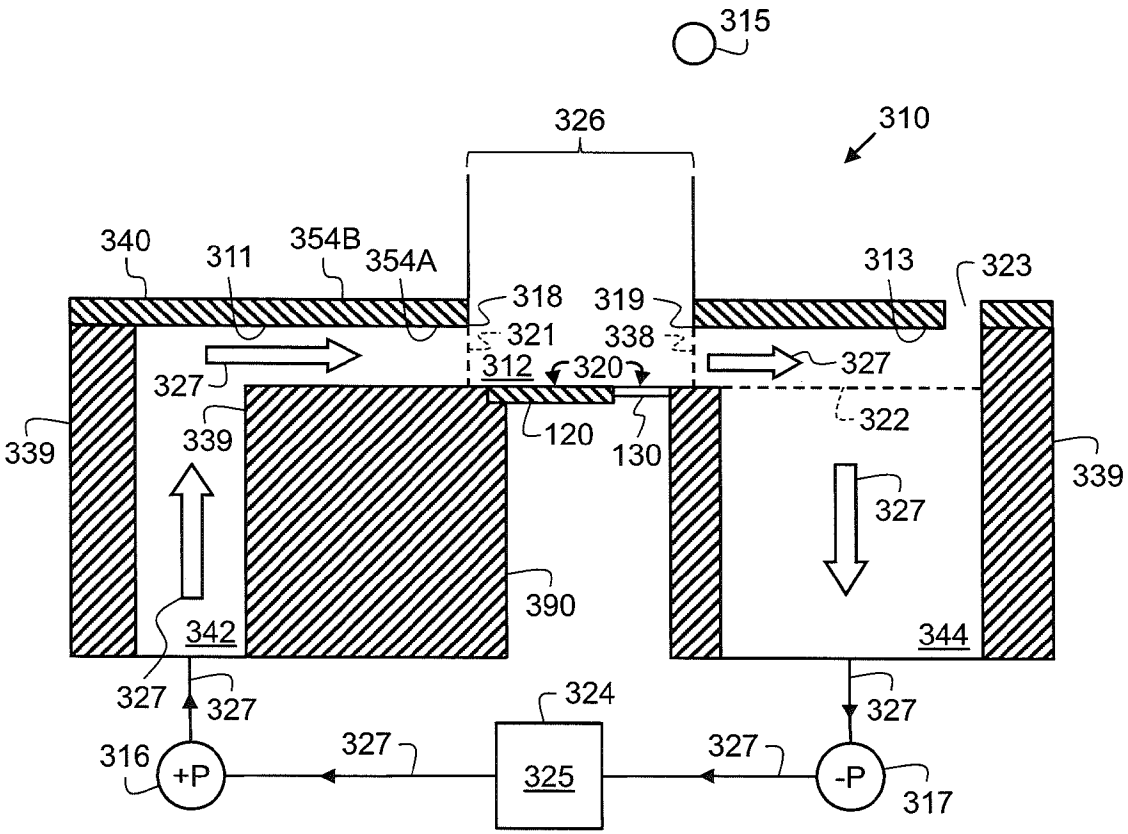
FIGS. 19A and 19B are schematic cross sectional views of example embodiments of a liquid dispenser made in accordance with the present invention.
Figure 19B:
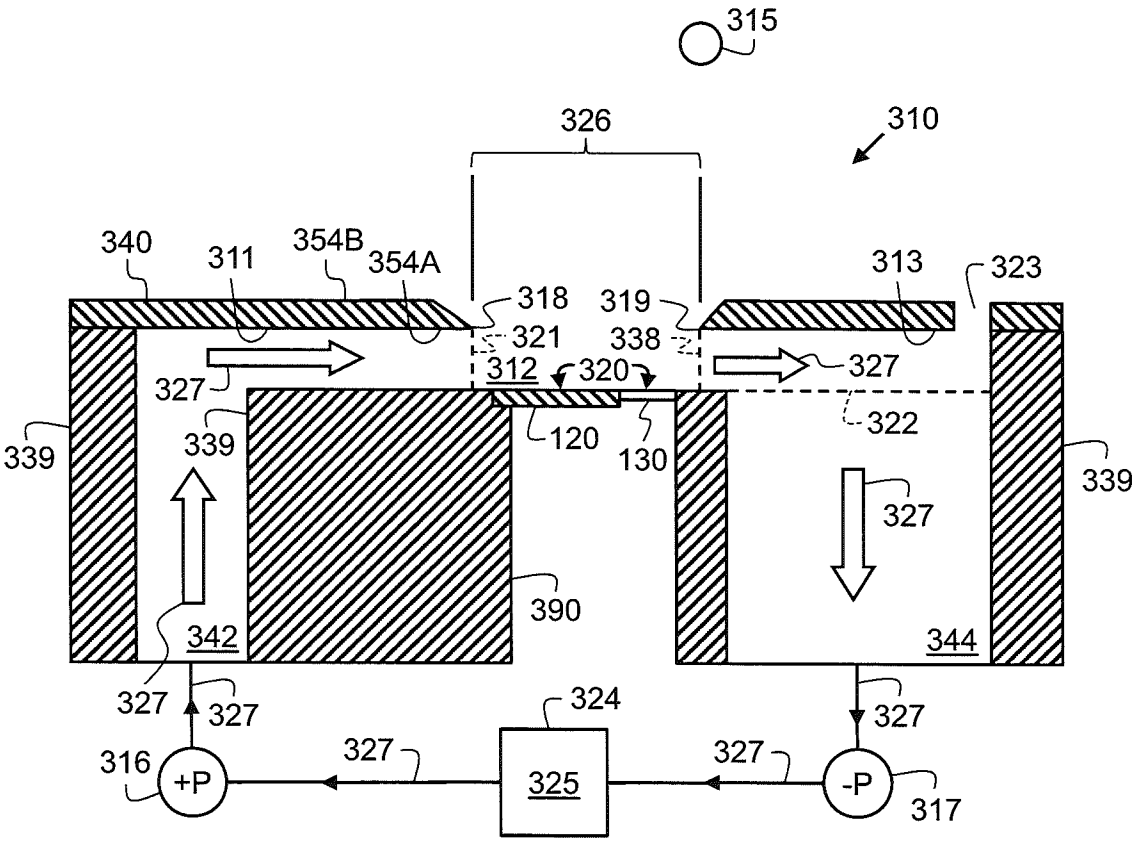

Referring to FIGS. 19A and 19B, example embodiments of a liquid dispenser 310 made in accordance with the present invention are shown. Liquid dispenser 310 includes a liquid supply channel 311 that is in fluid communication with a liquid return channel 313 through a liquid dispensing channel 312. Liquid dispensing channel 312 includes a diverter member 320. Liquid supply channel 311 includes an exit 321 while liquid return channel 313 includes an entrance 338.

Liquid dispensing channel 312 includes an outlet opening 326, defined by an upstream edge 318 and a downstream edge 319 that opens directly to atmosphere. Outlet opening 326 is different when compared to conventional nozzles because the area of the outlet opening 326 does not determine the size of the ejected drops. Instead, the actuation of diverter member 320 determines the size (volume) of the ejected drop 315. Typically, the size of drops created is proportional to the amount of liquid displaced by the actuation of diverter member 320. The upstream edge 318 of outlet opening 326 also at least partially defines the exit 321 of liquid supply channel 311 while the downstream edge 319 of outlet opening 326 also at least partially defines entrance 338 of liquid return channel 313.

Figure 21A:
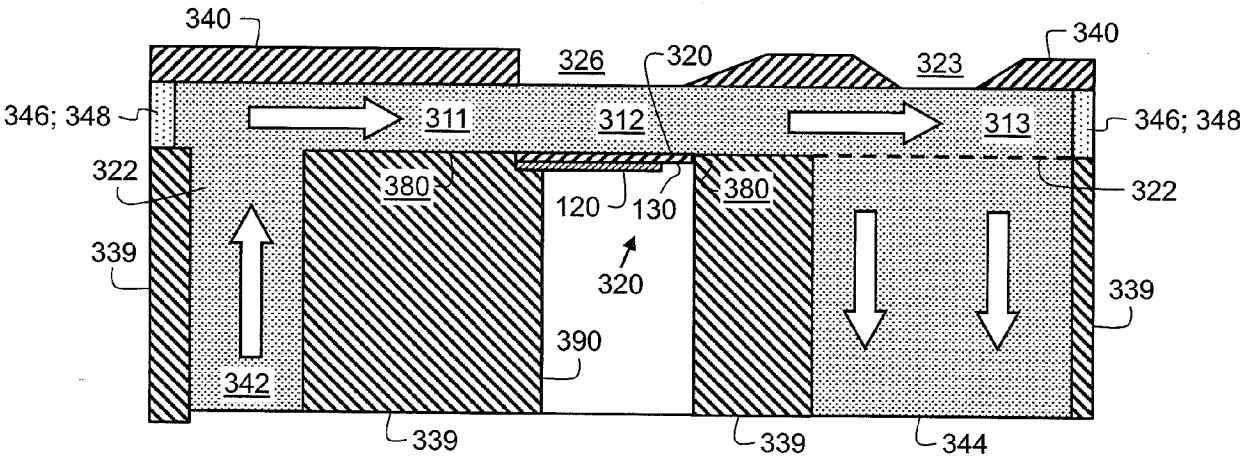
FIGS. 21A and 21B are a schematic cross sectional view and a schematic plan view, respectively, of another example embodiment of a liquid dispenser made in accordance with the present invention.
Figure 22A:
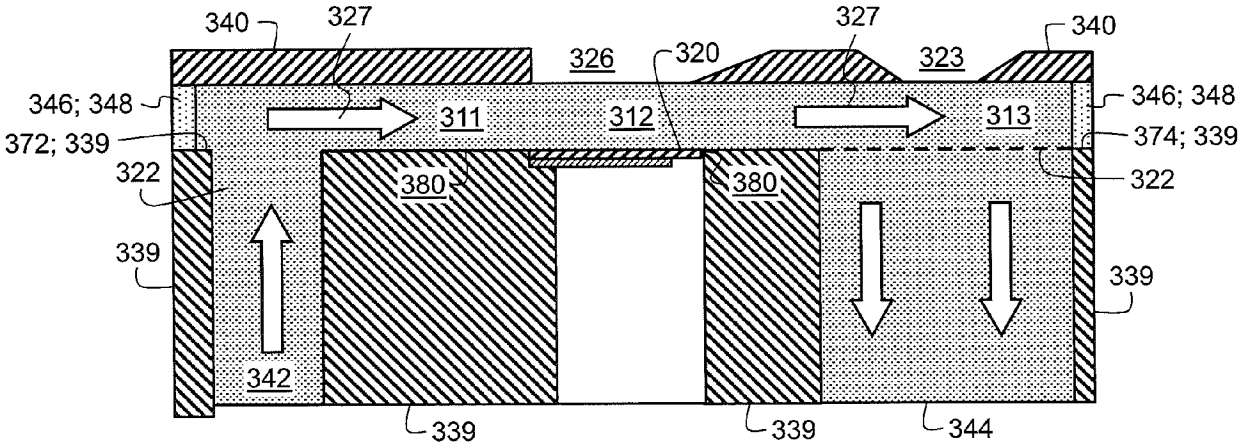
FIGS. 22A and 22B are a schematic cross sectional view and a schematic plan view, respectively, of another example embodiment of a liquid dispenser made in accordance with the present invention.

A wall 340 that defines outlet opening 326 includes a surface 354. Surface 354 can be either an interior surface 354A or an exterior surface 354B. In FIG. 19A, upstream edge 318 and downstream edge 319, as viewed in the direction of liquid flow 327 through liquid dispensing channel 312, of outlet opening 326 are perpendicular relative to the surface 354. However, either or both of upstream edge 318 and downstream edge 319, as viewed in the direction of liquid flow 327 through liquid dispensing channel 312, of outlet opening 326 can be sloped (angled) relative to the surface 354 of wall 340 of liquid dispensing channel 312. It is believed that providing downstream edge 319 with a slope (angle) helps facilitate drop ejection. In FIG. 19B both upstream edge 318 and downstream edge 319, as viewed in the direction of liquid flow 327 through liquid dispensing channel 312, of outlet opening 326 are sloped. In FIGS. 21A and 22A, discussed in more detail below, only downstream edge 319, as viewed in the direction of liquid flow 327 through liquid dispensing channel 312, of outlet opening 326 is sloped.

Liquid ejected by liquid dispenser 310 of the present invention does not need to travel through a conventional nozzle which typically has a smaller area. This helps reduce the likelihood of the outlet opening 326 becoming contaminated or clogged by particle contaminants. Using a larger outlet opening 326 (as compared to a conventional nozzle) also reduces latency problems at least partially caused by evaporation in the nozzle during periods when drops are not being ejected. The larger outlet opening 326 also reduces the likelihood of satellite drop formation during drop ejection because drops are produced with shorter tail lengths.

Diverter member 320, associated with liquid dispensing channel 312, for example, positioned on or in substrate 339, is selectively actuatable to divert a portion of liquid 325 toward and through outlet opening 326 of liquid dispensing channel 312 in order to form and eject a drop 315. Diverter member 320 includes one of the MEMS composite transducers 100 described above. Extending over a cavity 390 in substrate 339, the MEMS composite transducer 100 is selectively movable into and out of liquid dispensing channel 312 during actuation to divert a portion of the liquid flowing through liquid dispensing channel 312 toward outlet opening 326.

As shown in FIGS. 19A and 19B, liquid supply channel 311, liquid dispensing channel 312, and liquid return channel 313 are partially defined by portions of substrate 339. These portions of substrate 339 can also be referred to as a wall or walls of one or more of liquid supply channel 311, liquid dispensing channel 312, and liquid return channel 313. A wall 340 defines outlet opening 326 and also partially defines liquid supply channel 311, liquid dispensing channel 312, and liquid return channel 313. Portions of substrate 339 also define a liquid supply passage 342 and a liquid return passage 344. Again, these portions of substrate 339 can be referred to as a wall or walls of liquid supply passage 342 and liquid return passage 344. As shown in FIGS. 19A and 19B, liquid supply passage 342 and liquid return passage 344 are perpendicular to liquid supply channel 311, liquid dispensing channel 312, and liquid return channel 313.

A liquid supply 324 is connected in fluid communication to liquid dispenser 310. Liquid supply 324 provides liquid 325 to liquid dispenser 310. During operation, liquid 325, pressurized by a regulated pressure supply source 316, for example, a pump, flows (represented by arrows 327) from liquid supply 324 through liquid supply passage 342, through liquid supply channel 311, through liquid dispensing channel 312, through liquid return channel 313, through liquid return passage 344, and back to liquid supply 324 in a continuous manner. When a drop 315 of liquid 325 is desired, diverter member 320 is actuated causing a portion of the liquid 325 continuously flowing through liquid dispensing channel 312 to be urged toward and through outlet opening 326. Typically, regulated pressure supply source 316 is positioned in fluid communication between liquid supply 324 and liquid supply channel 311 and provides a positive pressure that is above atmospheric pressure.

Optionally, a regulated vacuum supply source 317, for example, a pump, can be included in the liquid delivery system of liquid dispenser 310 in order to better control liquid flow through liquid dispenser 310. Typically, regulated vacuum supply source 317 is positioned in fluid communication between liquid return channel 313 and liquid supply 324 and provides a vacuum (negative) pressure that is below atmospheric pressure.

Liquid return channel 313 or liquid return passage 344 can optionally include a porous member 322, for example, a filter, which in addition to providing particulate filtering of the liquid flowing through liquid dispenser 310 helps to accommodate liquid flow and pressure changes in liquid return channel 313 associated with actuation of diverter member 320 and a portion of liquid 325 being deflected toward and through outlet opening 326. This reduces the likelihood of liquid other than the ejected drop 315 spilling over outlet opening 326 of liquid dispensing channel 312 during or following actuation of diverter member 320. The likelihood of air being drawn into liquid return passage 344 is also reduced when porous member 322 is included in liquid dispenser 310.

Porous member 322 is typically integrally formed in liquid return channel 313 during the manufacturing process that is used to fabricate liquid dispenser 310. Alternatively, porous member 322 can be made from a metal or polymeric material and inserted into liquid return channel 313 or affixed to one or more of the walls that define liquid return channel 313. As shown in FIGS. 19A and 19B, porous member 322 is positioned in liquid return channel 313 in the area where liquid return channel 313 and liquid return passage 344 intersect. As such, either liquid return passage 344 includes porous member 322 or that liquid return channel 313 includes porous member 322. Alternatively, porous member 322 can be positioned in liquid return passage 344 downstream from its location as shown in FIGS. 19A and 19B.

Regardless of whether porous member 322 in integrally formed or fabricated separately, the pores of porous member 322 have a substantially uniform pore size. Alternatively, the pore size of the pores of porous member 322 include a gradient so as to be able to more efficiently accommodate liquid flow through the liquid dispenser 310 (for example, larger pore sizes (alternatively, smaller pore sizes) on an upstream portion of the porous member 322 that decrease (alternatively, increase) in size at a downstream portion of porous member 322 when viewed in a direction of liquid travel). The specific configuration of the pores of porous member 322 typically depends on the specific application contemplated. Example embodiments of this aspect of the present invention are discussed in more detail below.

Typically, the location of porous member 322 varies depending on the specific application contemplated. As shown in FIGS. 19A and 19B, porous member 322 is positioned in liquid return channel 313 parallel to the flow direction 327 of liquid 325 in liquid dispensing channel 312 such that the center axis of the openings (pores) of porous member 322 are substantially perpendicular to the liquid flow 327 in the liquid dispensing channel. Porous member 322 is positioned in liquid return channel 313 at a location that is spaced apart from outlet opening 326 of liquid dispensing channel 312. Porous member 322 is also positioned in liquid return channel 313 at a location that is adjacent to the downstream edge 319 of outlet opening 326 of liquid dispensing channel 312. As described above, the likelihood of air being drawn into liquid return passage 344 is reduced because the difference between atmospheric pressure and the negative pressure provided by the regulated vacuum supply source 317 is less than the meniscus pressure of porous member 322.

Additionally, liquid return channel 313 includes a vent 323 that opens liquid return channel 313 to atmosphere. Vent 323 helps to accommodate liquid flow and pressure changes in liquid return channel 313 associated with actuation of diverter member 320 and a portion of liquid 325 being deflected toward and through outlet opening 326. This reduces the likelihood of unintended liquid spilling (liquid other than liquid drop 315) over outlet opening 326 of liquid dispensing channel 312 during or after actuation of diverter member 320. In the event that liquid does spill over outlet opening 326, vent 323 also acts as a drain that provides a path back to liquid return channel 313 for any overflowing liquid. As such, the terms "vent" and "drain" are used interchangeably herein.

Liquid dispenser 310 is typically formed from a semiconductor material (for example, silicon) using known semiconductor fabrication techniques (for example, CMOS circuit fabrication techniques, micro-mechanical structure (MEMS) fabrication techniques, or combinations of both). Alternatively, liquid dispenser 310 is formed from any materials using any fabrication techniques known in the art.

The liquid dispensers 310 of the present invention, like conventional drop-on-demand printheads, only create drops when desired, eliminating the need for a gutter and the need for a drop deflection mechanism which directs some of the created drops to the gutter while directing other drops to a print receiving media. The liquid dispensers of the present invention use a liquid supply that continuously supplies liquid, for example, ink under pressure through liquid dispensing channel 312. The supplied ink pressure serves as the primary motive force for the ejected drops, so that most of the drop momentum is provided by the ink supply rather than by a drop ejection actuator at the nozzle. In other words, the continuous pressurized liquid flow through the liquid dispenser provides the momentum needed for drop formation and liquid/drop travel through the outlet opening. The continuous flow of liquid through liquid dispenser 310 is internal relative to liquid dispenser 310 in contrast with a continuous liquid ejection system in which the liquid jet that is ejected through a nozzle is ejected externally relative to the continuous liquid ejection system.

Figure 20A:
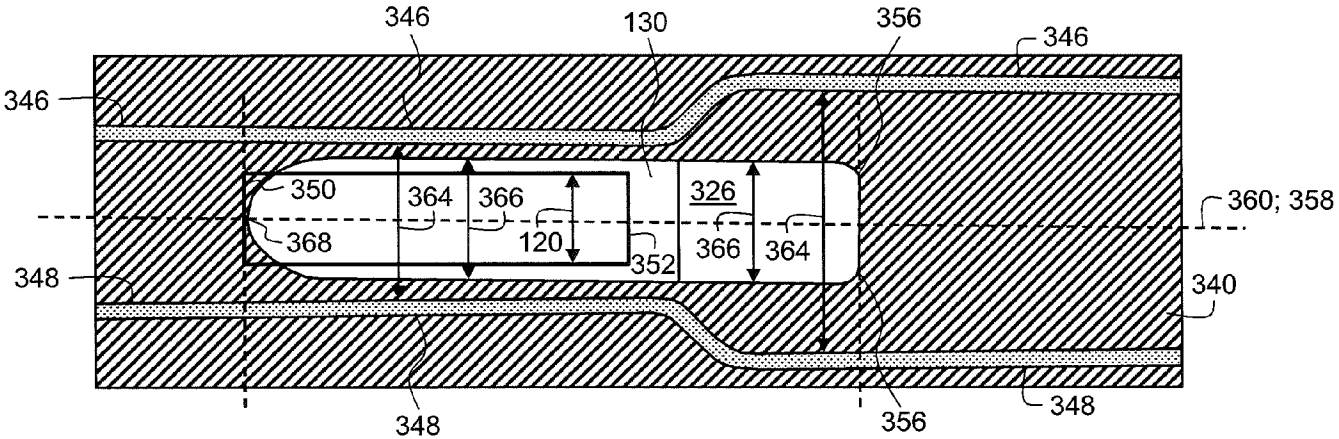
FIGS. 20A and 20B are a schematic plan view and a schematic cross sectional view, respectively, of another example embodiment of a liquid dispenser made in accordance with the present invention.

Referring to FIGS. 20A-20D and back to FIGS. 19A and 19B, additional example embodiments of liquid dispenser 310 are shown. In FIG. 20A, a plan view of liquid dispenser 310, wall 346 and wall 348 define a width, as viewed perpendicular to the direction of liquid flow 327 (shown in FIG. 20B), of liquid dispensing channel 312 and a width, as viewed perpendicular to the direction of liquid flow 327 (shown in FIG. 20B), of liquid supply channel 311 and liquid return channel 313. The MEMS transducing member (for example, cantilever beam 120) and compliant membrane 130 of diverter member 320 are also included in FIG. 20A. Additionally, a length, as viewed along the direction of liquid flow 327 (shown in FIG. 20B), and a width, as viewed perpendicular to the direction of liquid flow 327 (shown in FIG. 20B), of outlet opening 326 relative to the length and width of liquid dispensing channel 312 are shown in FIG. 20A.

Figure 20B:
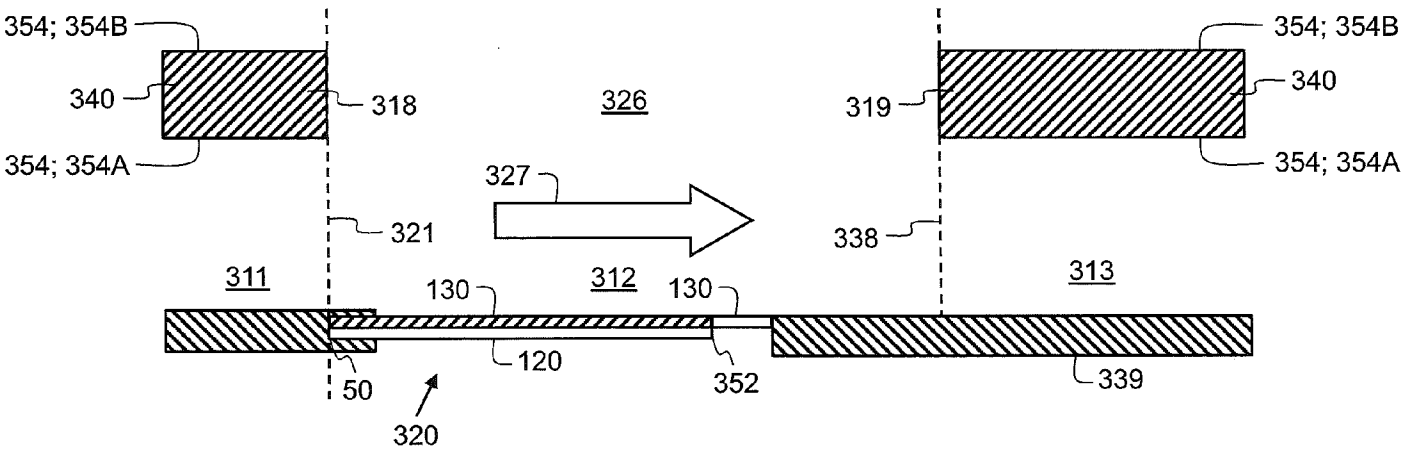
Figure 20C:
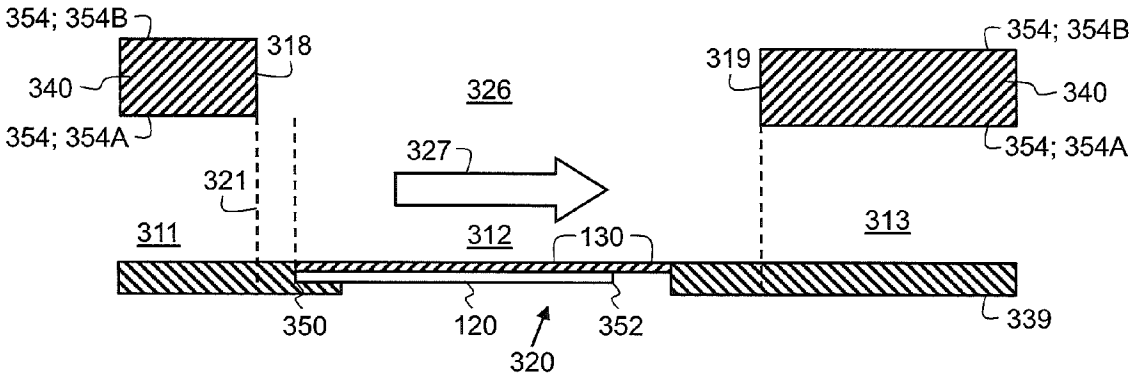
FIGS. 20C and 20D are schematic cross sectional views of the liquid dispenser shown in FIG. 20A showing additional example embodiments of a liquid dispenser made in accordance with the present invention.
Figure 20D:
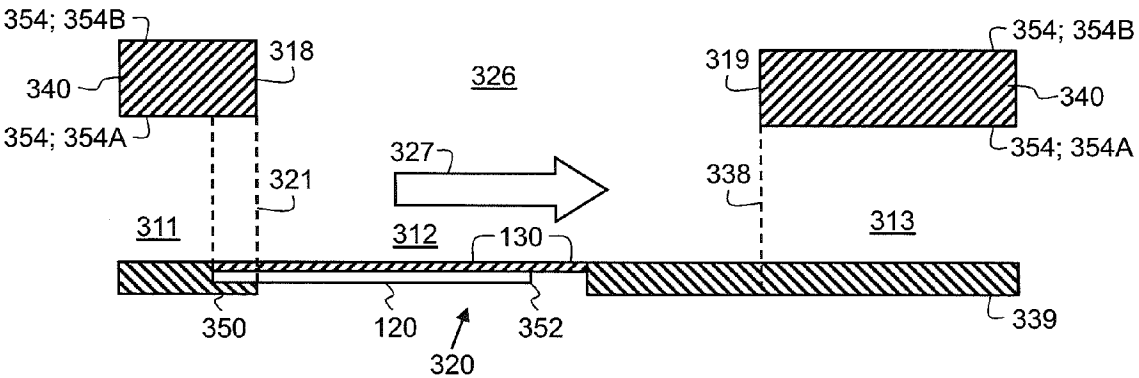

In FIGS. 20B-20D, the location of the MEMS transducing member (for example, cantilever beam 120) and compliant membrane 130 of diverter member 320 relative to the exit 321 of liquid supply channel 311 and the upstream edge 318 of outlet opening 326 is shown. In FIG. 20B, an upstream edge 350 of diverter member 320 is located at the exit 321 of liquid supply channel 311 and the upstream edge 318 of outlet opening 326. A downstream edge 352 of diverter member 320 is located upstream from the downstream edge 319 of outlet opening 326 and the entrance 338 of liquid return channel 313. In FIG. 20C, an upstream edge 350 of diverter member 320 is located in liquid dispensing channel 312 downstream from the exit 321 of liquid supply channel 311 and the upstream edge 318 of outlet opening 326. The downstream edge 352 of diverter member 320 is located upstream from the downstream edge 319 of outlet opening 326 and the entrance 338 of liquid return channel 313. In FIG. 20D, upstream edge 350 of diverter member is located in liquid supply channel 311, upstream from the exit 321 of liquid supply channel 311 and the upstream edge 318 of outlet opening 326. The downstream edge 352 of diverter member 320 is located upstream from the downstream edge 319 of outlet opening 326 and the entrance 338 of liquid return channel 313. Depending on the application contemplated, the relative location of diverter member 320 to exit 321 and entrance 338 is used to control or adjust characteristics (for example, the angle of trajectory, volume, or velocity) of ejected drops 315.

Referring to FIGS. 21A-22B and back to FIGS. 19A and 19B, liquid dispensing channel 312 includes a first wall 340. Wall 340 includes a surface 354 (either interior surface 354A or exterior surface 354B). A portion of first wall 340 defines an outlet opening 326. Liquid dispensing channel 312 also includes a second wall 380 positioned opposite first wall 340. Second wall 380 of liquid dispensing channel 312 extends along a portion of liquid supply channel 311 and along a portion of liquid return channel 313. A liquid supply passage 342 extends through second wall 380 and is in fluid communication with liquid supply channel 311. Liquid supply passage 342 includes a porous member 322. A liquid return passage 344 extends through second wall 380 and is in fluid communication with liquid return channel 313. Liquid return passage includes a porous member 322. A liquid supply 324 provides liquid that continuously flows from liquid supply passage 342 through the liquid supply channel 311, through liquid dispensing channel 312, through liquid return channel 313 to liquid return passage 344 and back to liquid supply 324. Diverter member 320 selectively diverts a portion of the flowing liquid through outlet opening 326 of liquid dispensing channel 312.

As shown in FIGS. 21A-22B, porous member 322 is positioned in liquid supply channel 311 in the area where liquid supply channel 311 and liquid supply passage 342 intersect. As such, either liquid supply passage 342 includes porous member 322 or that liquid supply channel 311 includes porous member 322. Alternatively, porous member 322 can be positioned in liquid supply passage 342 upstream from its location as shown in FIGS. 21A-22B. Also, as shown in FIGS. 21A-22B, porous member 322 is positioned in liquid return channel 313 in the area where liquid return channel 313 and liquid return passage 344 intersect. As such, either liquid return passage 344 includes porous member 322 or that liquid return channel 313 includes porous member 322. Alternatively, porous member 322 can be positioned in liquid return passage 344 downstream from its location as shown in FIGS. 21A-22B.

Figure 21B:
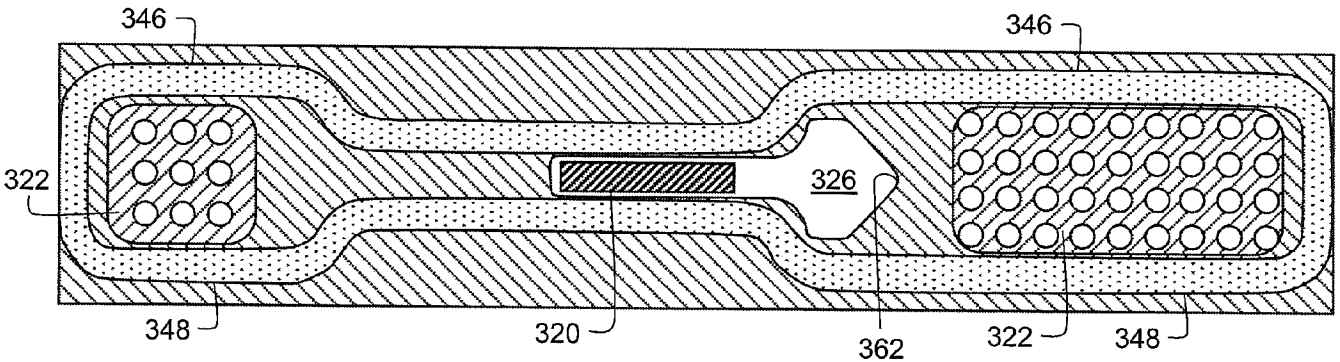
Figure 22B:
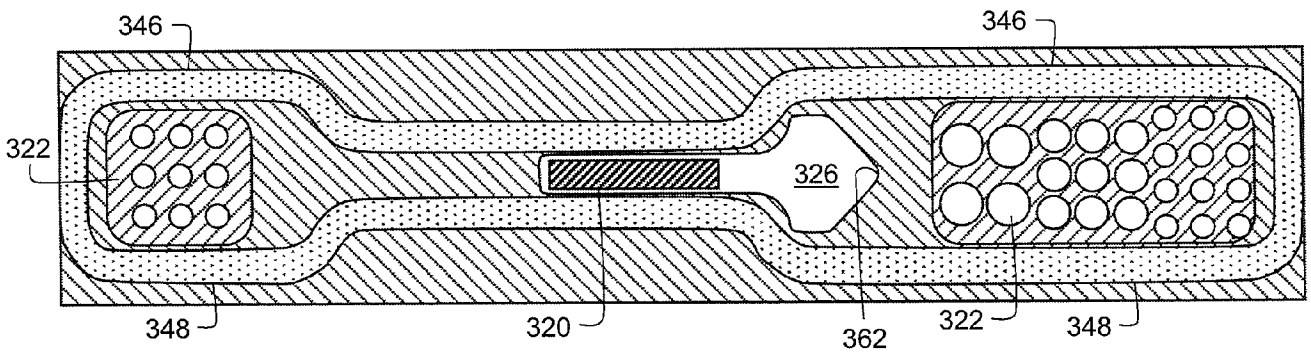

As shown in FIGS. 21A and 21B, porous member 322 includes pores that have the same size. Alternatively, porous member 322 includes pores that have variations in size when compared to each other. As shown in FIGS. 22A and 22B, the pore size varies monotonically along the direction of the liquid flow 327 through liquid dispensing channel 312 to provide distinct liquid flow impedances. Alternatively, the pores of porous member 322 are shaped differently to provide distinct liquid flow impedances in other example embodiments. In FIGS. 21B-22B, drain 323 has been removed from each "B" figure so that the liquid return passage 344 and porous member 322 can be seen more clearly.

Referring to FIGS. 19A and 20B, wall 340, defining outlet opening 326, includes a surface 354. Surface 354 can be either interior surface 354A or exterior surface 354B. The downstream edge 319, as viewed in the direction of liquid flow 327 through liquid dispensing channel 312, of outlet opening 326 is perpendicular relative to the surface 354 of wall 340 of liquid dispensing channel 312.

Downstream edge 319 of outlet opening 326 can include other features. For example, as shown in FIG. 20A, the central portion of the downstream edge 319 of outlet opening 326 is straight when viewed from a direction perpendicular to surface 354 of wall 340. When central portion of the downstream edge 319 is straight, the corners 356 of downstream edge 319 are rounded in some example embodiments, to provide mechanical stability and reduce stress induced cracks in wall 340. It is believed, however, that it is more preferable to configure the downstream edge 319 of outlet opening 326 to include a radius of curvature when viewed from a direction perpendicular to the surface 354 of wall 340 as shown in FIGS. 21B and 22B in order to improve the drop ejection performance of liquid dispenser 310. The radius of curvature is different at different locations along the arc of the curve in some embodiments. In this sense, the radius of curvature can include a plurality of radii of curvature.

Referring to FIG. 20A, outlet opening 326 includes a centerline 358 along the direction of the liquid flow 327 through liquid dispensing channel 312 as viewed from a direction perpendicular to surface 354 of wall 340 of liquid dispensing channel 312. Liquid dispensing channel 312 includes a centerline 360 along the direction of the liquid flow 327 through liquid dispensing channel 312 as viewed from a direction perpendicular to surface 354 of wall 340 of liquid dispensing channel 312. As shown in FIG. 20A, liquid dispensing channel 312 and outlet opening 326 share this centerline 358, 360.

It is believed that it is still more preferable to configure the downstream edge 319 of the outlet opening 326 such that it tapers towards the centerline 358 of the outlet opening 326, as shown in FIGS. 21B and 22B, in order to improve the drop ejection performance of liquid dispenser 310. The apex 362 of the taper can include a radius of curvature when viewed from a direction perpendicular to the surface 354 of wall 340 to provide mechanical stability and reduce stress induced cracks in wall 340.

In some example embodiments, the overall shape of the outlet opening 326 is symmetric relative to the centerline 358 of the outlet opening 326. In other example embodiments, the overall shape of the liquid dispensing channel 312 is symmetric relative to the centerline 360 of the liquid dispensing channel 312. It is believed, however, that optimal drop ejection performance can be achieved when the overall shape of the liquid dispensing channel 312 and the overall shape of the outlet opening 326 are symmetric relative to a shared centerline 358, 360.

Referring to FIGS. 19A, 21B, and 22B, liquid dispensing channel 312 includes a width 364 that is perpendicular to the direction of liquid flow 327 through liquid dispensing channel 312. Outlet opening 326 also includes a width 366 that is perpendicular to the direction of liquid flow 327 through liquid dispensing channel 312. The width 366 of the outlet opening 326 is less than the width 364 of the liquid dispensing channel 312.

In the example embodiments of the present invention described herein, the width 364 of the liquid dispensing channel 312 is greater at a location that is downstream relative to diverter member 320. Additionally, liquid return channel 313 is wider than the width of liquid dispensing channel 312 at the upstream edge 318 of the liquid dispensing channel 312. Liquid return channel 313 is also wider than the width of liquid supply channel 311 at its exit 321. This feature helps to control the meniscus height of the liquid in outlet opening 326 so as to reduce or even prevent liquid spills.

In the example embodiment shown in FIG. 20A, the width 366 of outlet opening 326 remains constant along the length of the outlet opening 326 until the downstream edge 319 of the outlet opening is encountered. The width 366 of outlet opening 326 varies in other embodiments, however. For example, in the example embodiments shown in FIGS. 21B and 22B, the width 366 of outlet opening 326 is greater at a location that is downstream relative to diverter member 320 and upstream relative to the downstream edge 319 of the outlet opening when compared to the width 366 of outlet opening 326 at a location in the vicinity of diverter member 320. It is believed that this configuration helps achieve optimal drop ejection performance.

Referring to FIGS. 21A and 22A, wall 340, defining outlet opening 326, includes a surface 354. Surface 354 can be either interior surface 354A or exterior surface 354B. The downstream edge 319, as viewed in the direction of liquid flow 327 through liquid dispensing channel 312, of outlet opening 326 is sloped (angled) relative to the surface 354 of wall 340 of liquid dispensing channel 312. It is believed that providing downstream edge 319 with a slope (angle) helps facilitate drop ejection.

Referring back to FIGS. 19A-22B, liquid return channel 313 is shown having a cross-sectional area that is greater than the cross-sectional area of liquid dispensing channel 312. This features also helps to minimize pressure changes associated with actuation of diverter member 320 and a portion of liquid 325 being deflected toward and through outlet opening 326 which reduces the likelihood of air being drawn into liquid return channel 313 or liquid spilling over outlet opening 326 following actuation of diverter member 320.

Liquid supply channel 311 includes an exit 321 that has a cross sectional area. Liquid dispensing channel 312 includes an outlet opening 326 that includes an end 319 that is adjacent to liquid return channel 313. Liquid dispensing channel 312 also has a cross sectional area. The cross sectional area of a portion of liquid dispensing channel 312 that is located at the end 319 of outlet opening 326 is greater than the cross sectional area of the exit 321 of liquid supply channel 311. This feature helps to minimize pressure changes associated with actuation of diverter member 320 and the deflecting of a portion of liquid 325 toward outlet opening 326 which reduces the likelihood of air being drawn into liquid return channel 313 or liquid spilling over outlet opening 326 during actuation of diverter member 320.

Figure 23B:
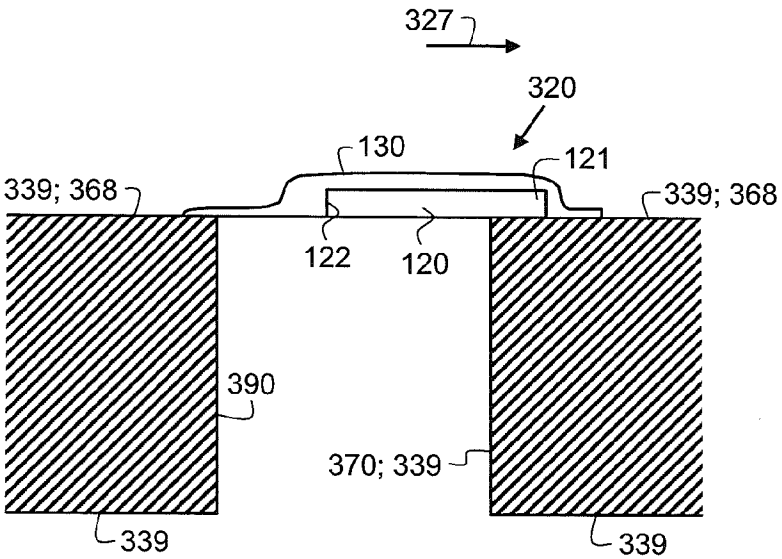
FIGS. 23A and 23B are partial schematic cross-sectional views of a portion of the diverter member shown in FIGS. 19A and 19B.
Figure 23A:
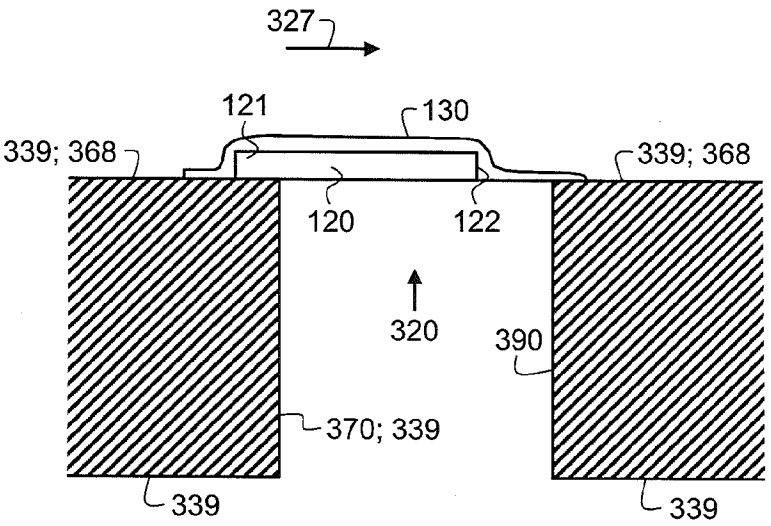

Referring to FIGS. 23A and 23B and back to FIGS. 1A-2 and 19A-22B, a first portion 368 of substrate 339 defines liquid dispensing channel 312 and a second portion 370 of substrate 339 defines an outer boundary of cavity 390. Other portions 372, 374 of substrate 339 define liquid supply channel 311 and liquid return channel 313. Liquid supply 324 provides a flow of liquid 325 continuously from liquid supply 324 through the liquid supply channel 311 through the liquid dispensing channel 312 through the liquid return channel 313 and back to liquid supply 324. Diverter member 320 is selectively actuated to divert a portion of the liquid 325 flowing through liquid dispensing channel 312 through outlet opening 326 of liquid dispensing channel 312. Diverter member 320 is located in liquid dispensing channel 312 opposite outlet opening 326.

Diverter member 320 includes a MEMS transducing member and a compliant membrane 130. In FIGS. 1A-2 and 19A-23B, the MEMS transducing member includes cantilevered beam 120. A first portion 121 of the MEMS transducing member is anchored to substrate 339 and a second portion 122 of the MEMS transducing member extends over at least a portion of cavity 390 formed in substrate 339. The second portion 122 of the MEMS transducing member is free to move relative to cavity 390. When actuated, diverter member 320 moves into liquid dispensing channel 312. Typically, compliant membrane 130 is a compliant polymeric membrane made from one of the polymers described above. However, compliant membrane 130 can be any of the compliant membranes described above depending on the specific application contemplated.

A compliant membrane 130 is positioned in contact with the MEMS transducing member. A first portion 131 of compliant membrane 130 covers the MEMS transducing member and a second portion 132 of compliant membrane 130 is anchored to substrate 339 such that compliant membrane 130 forms a portion of a wall 376 of liquid dispensing channel 312 that is opposite outlet opening 326.

In some example embodiments, porous membrane 322 is fabricated in a portion of compliant membrane 130 when compliant membrane 130 extends across substrate 339 to cover liquid supply passage 342 or liquid return passage 344.

The continuous flow of liquid 325 flows in a direction 327. As shown in FIG. 23A, the first portion 121 of the MEMS transducing member that is anchored to substrate 339 is an upstream portion 378 of the MEMS transducing member relative to the direction 327 of liquid flow. As shown in FIG. 23B, the first portion 121 of the MEMS transducing member that is anchored to substrate 339 is a downstream portion 382 of the MEMS transducing member relative to the direction 327 of liquid flow. When positioned as shown in FIG. 23B, second portion 122 of cantilevered beam 120 should be located downstream from the upstream edge 318 of outlet opening 326 in order to ensure consistent drop ejection. First portion 121 of cantilevered beam 120 can be located either upstream or downstream from the downstream edge 319 of outlet opening 326 depending on the contemplated application.

In some example embodiments of liquid dispenser 310, cavity 390 is filled with a gas, for example, air. When filled with air, cavity 390 can be vented to atmosphere. In other example embodiments of liquid dispenser 310, cavity 390 is filled with a liquid, for example, the liquid being ejected by liquid dispenser 310 or cavity 390 has a liquid flowing through it. When cavity 390 includes a liquid, it helps equalize the pressure on both sides of diverter member 320.

Figure 24A:
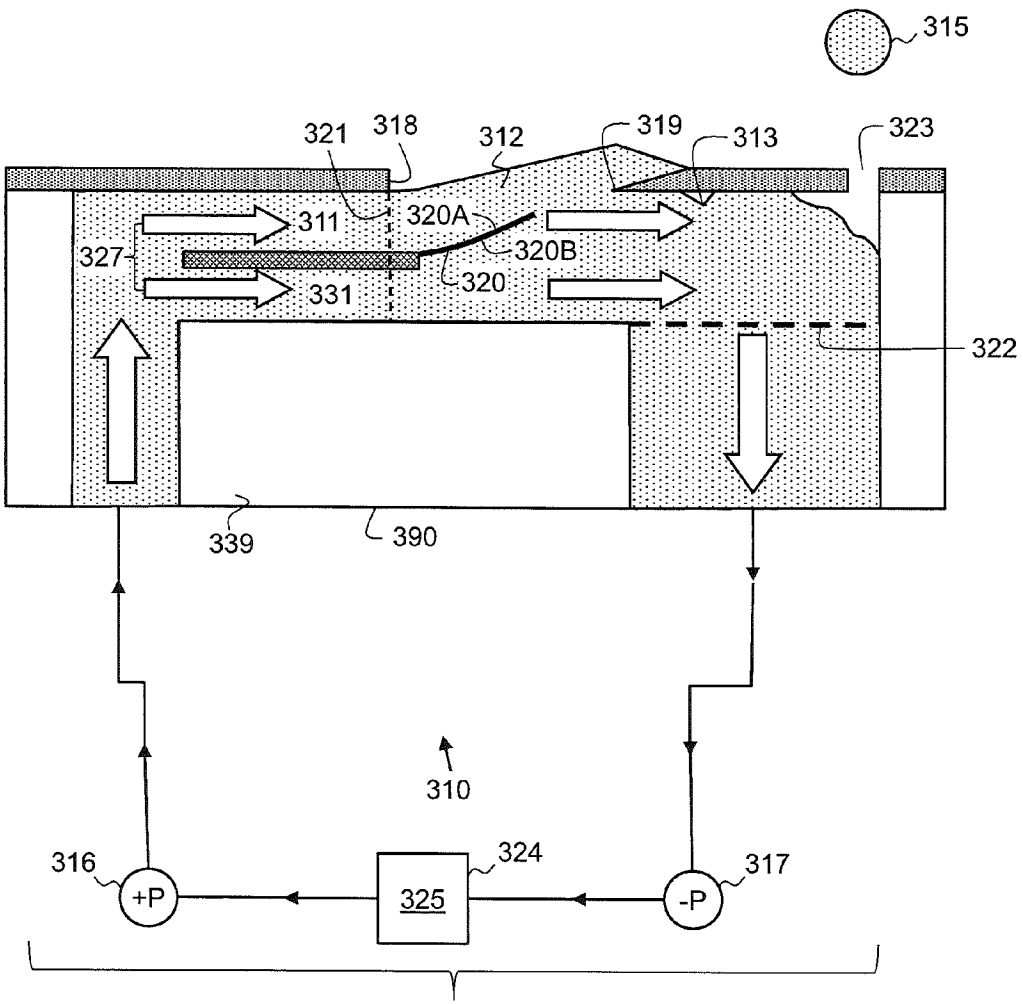
FIG. 24A is a schematic cross-sectional view of another example embodiment of a liquid dispenser made in accordance with the present invention.
Figure 24B:
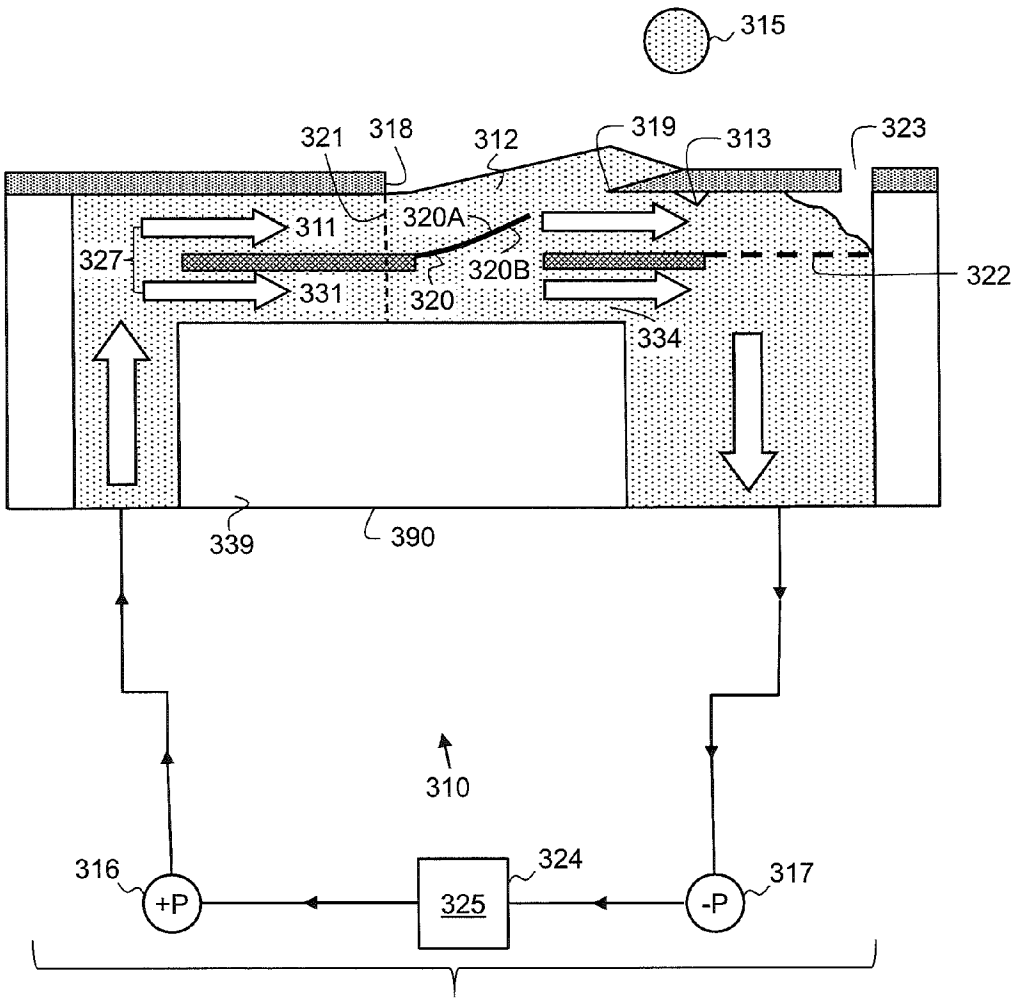
FIG. 24B is a schematic cross-sectional view of another example embodiment of a liquid dispenser made in accordance with the present invention.
Figure 24C:
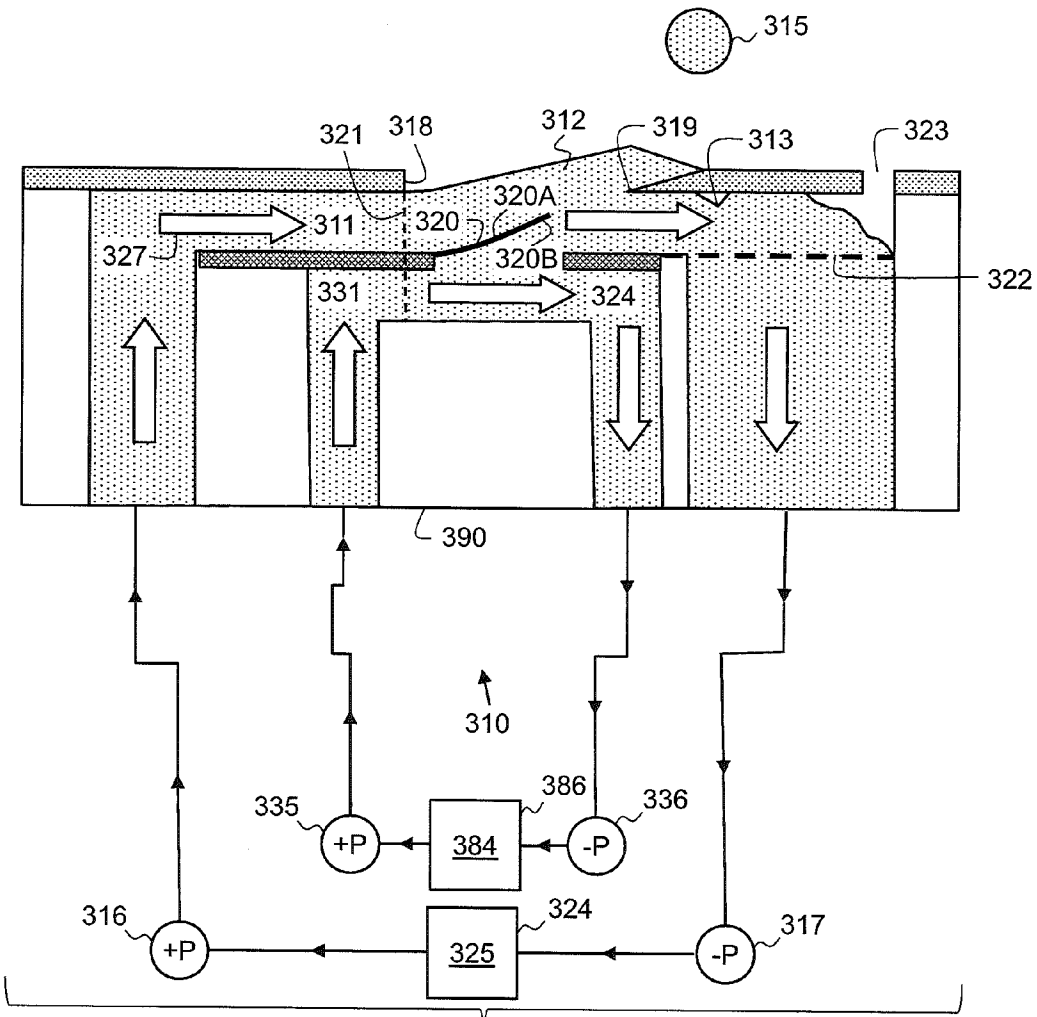
FIG. 24C is a schematic cross-sectional view of another example embodiment of a liquid dispenser made in accordance with the present invention.

Referring to FIGS. 24A-24C and back to FIGS. 1A-2 and 19A-23B, cavity 390 is connected in liquid communication with liquid supply channel 311 and liquid return channel 313. Diverter member 320 is selectively movable into and out of liquid dispensing channel 312 during actuation. Diverter member 320 includes a first side 320A that faces liquid dispensing channel 312 and a second side 320B that faces cavity 390.

Diverter member 320 includes a MEMS transducing member and a compliant membrane. In FIGS. 24A-24C, the MEMS transducing member includes cantilevered beam 120. Compliant membrane 130 is positioned in contact with the MEMS transducing member. A first portion 131 of compliant membrane 130 covers the MEMS transducing member and a second portion 132 of compliant membrane 130 is anchored to a portion of a wall of substrate 339 that defines liquid dispensing channel 312. Diverter member 320 is positioned opposite outlet opening 326. Typically, compliant membrane 130 is a compliant polymeric membrane made from one of the polymers described above. However, compliant membrane 130 can be any of the compliant membranes described above depending on the specific application contemplated.

Optionally, an insulating material covers a surface of the MEMS transducing member that is opposite a surface of the MEMS transducing member that contacts the compliant membrane. For example, a compliant passivation material 138 can be included on the side of the MEMS transducing material that is opposite the side that the portion 131 of compliant membrane 130 is formed on, as described above with reference to FIG. 14, when cavity 390 is filled with a liquid or has a liquid flowing through it. Compliant passivation material 138 together with portion 131 of compliant membrane 130 provide protection of the MEMS transducing member (for example, cantilevered beam 120) from the fluid being directed through cavity 390.

In the example embodiment shown in FIG. 24A, a second liquid supply channel 331 supplies liquid 325 through cavity 390 to liquid return channel 313 that is common to liquid supply channel 311 and second liquid supply channel 331. First liquid supply channel 311 and second liquid supply channel 331 are physically distinct from each other.

In the example embodiment shown in FIG. 24B, liquid supply channel 311 is a first liquid supply channel and liquid return channel 313 is a first liquid return channel. Liquid dispenser 310 also includes a second liquid supply channel 331 that is in liquid communication with cavity 390. First liquid supply channel 311 and second liquid supply channel 331 are physically distinct from each other. A second liquid return channel 334 is in liquid communication with cavity 390. First liquid return channel 313 and second liquid return channel 334 are physically distinct from each other. Liquid supply 324 provides a continuous flow of liquid 325 from liquid supply 324 through first liquid supply channel 311 through liquid dispensing channel 312 through first liquid return channel 313 and back to liquid supply 324. Liquid supply 325 also provides a continuous flow of liquid 325 from liquid supply 324 through second liquid supply channel 331 through cavity 390 through second liquid return channel 334 and back to liquid supply 324.

Liquid dispensing channel 312 and cavity 390 are sized relative to each other so that liquid pressure on both sides of diverter member 320 is balanced. Keeping first liquid supply channel 311 and second liquid supply channel 331 physically separated from each other and keeping first liquid return channel 313 and second liquid return channel 334 physically separated from each other helps to facilitate pressure balancing on both sides of diverter member 320.

In the example embodiment shown in FIG. 24C, liquid supply channel 311 is a first liquid supply channel and liquid return channel 313 is a first liquid return channel. Liquid dispenser 310 also includes a second liquid supply channel 331 that is in liquid communication with cavity 390. First liquid supply channel 311 and second liquid supply channel 331 are physically distinct from each other. A second liquid return channel 334 is in liquid communication with cavity 390. First liquid return channel 313 and second liquid return channel 334 are physically distinct from each other.

Liquid supply 324 is a first liquid supply. Liquid supply 324 provides a continuous flow of liquid 325 from liquid supply 324 through first liquid supply channel 311 through liquid dispensing channel 312 through first liquid return channel 313 and back to liquid supply 324. Liquid dispenser 310 also includes a second liquid supply 386 that provides a continuous flow of liquid 325 from second liquid supply 386 through second liquid supply channel 331 through cavity 390 through second liquid return channel 334 and back to second liquid supply 386. In this embodiment, liquid 325 is a first liquid that is supplied by first liquid supply 324. Second liquid supply 386 provides a second liquid 384 through cavity 390. Depending on the application contemplated, first liquid 325 and second liquid 384 have the same formulation properties or have distinct formulation properties when compared to each other.

During operation, second liquid 384, pressurized above atmospheric pressure by a second regulated pressure source 335, for example, a pump, flows (represented by arrows 388) from second liquid supply 386 through second liquid supply channel 331, cavity 390, second liquid return channel 334, and back to second liquid supply 386 in a continuous manner. Optionally, a second regulated vacuum supply 336, for example, a pump, can be included in order to better control the flow of second liquid 384 through liquid dispenser 310. Typically, second regulated vacuum supply 336 is positioned in fluid communication between second liquid return channel 334 and second liquid supply 386 and provides a vacuum (negative) pressure that is below atmospheric pressure.

First liquid supply 324, using regulated pressure source 316 and, optionally, regulated vacuum source 317, regulates the velocity of the first liquid 325 moving through liquid dispensing channel 312 while second liquid supply 386, using second regulated pressure source 335 and, optionally, second regulated vacuum source 336, regulates the velocity of second liquid 384 moving through cavity 390 so that liquid pressure on both sides of diverter member 320 is balanced. This helps to minimize differences in liquid flow characteristics that may adversely affect liquid diversion and drop formation during operation.

As described above, liquid pressure balancing on both sides of diverter member 320 is also achieved by appropriately sizing liquid dispensing channel 312 and cavity 390 relative to each other. Again, keeping first liquid supply channel 311 and second liquid supply channel 331 are physically separated from each other and keeping first liquid return channel 313 and second liquid return channel 334 are physically separated from each other helps to facilitate pressure balancing on both sides of diverter member 320.

Referring to FIGS. 25A-25E and back to FIGS. 1A-2 and 19A-24C, additional example embodiments of a flow-through liquid dispenser 310 are shown. A first portion 368 of substrate 339 defines liquid dispensing channel 312 and a second portion 370 of substrate 339 defines a liquid supply channel 311 and a liquid return channel 313. Liquid dispensing channel 312 includes outlet opening 326. Liquid supply 324 provides a flow of liquid 325 continuously from liquid supply 324 through the liquid supply channel 311 through the liquid dispensing channel 312 through the liquid return channel 313 and back to liquid supply 324. Diverter member 320 is selectively actuated to divert a portion of the liquid 325 flowing through liquid dispensing channel 312 through outlet opening 326 of liquid dispensing channel 312. Diverter member 320 is positioned on a wall 340 of liquid dispensing channel 312 that includes the outlet opening 326.

Diverter member 320 includes a MEMS transducing member and a compliant membrane. In FIGS. 25A-25D, the MEMS transducing member includes cantilevered beam 120. A first portion 121 of the MEMS transducing member is anchored to wall 340 of liquid dispensing channel 312 that includes outlet opening 326. A second portion of the MEMS transducing member extends into a portion of liquid dispensing channel 312 that is adjacent to outlet opening 326. The second portion of the MEMS transducing member is free to move relative to outlet opening 326. When actuated, diverter member 320 moves toward liquid dispensing channel 312 or toward outlet 326 depending on where diverter member 320 is positioned.

A compliant membrane 130 is positioned in contact with the MEMS transducing member. A first portion 131 of compliant membrane 130 separates the MEMS transducing member from the continuous flow 327 of liquid 325 through liquid dispensing channel 312. A second portion 132 of compliant membrane 130 is anchored to the wall 340 of liquid dispensing channel 312 that includes outlet opening 326. Typically, compliant membrane 130 is a compliant polymeric membrane made from one of the polymers described above. However, compliant membrane 130 can be any of the compliant membranes described above depending on the specific application contemplated.

Optionally, an insulating material covers a surface of the MEMS transducing member that is opposite a surface of the MEMS transducing member that contacts the compliant membrane. For example, a compliant passivation material 138 can be included on the side of the MEMS transducing material that is opposite the side that first portion 131 of compliant membrane 130 is located, as described above with reference to FIG. 14. Compliant passivation material 138 together with first portion 131 of compliant membrane 130 provide protection of the MEMS transducing member (for example, cantilevered beam 120) from the fluid being directed through liquid dispensing channel 312 or outlet opening 326.

Figure 25A:
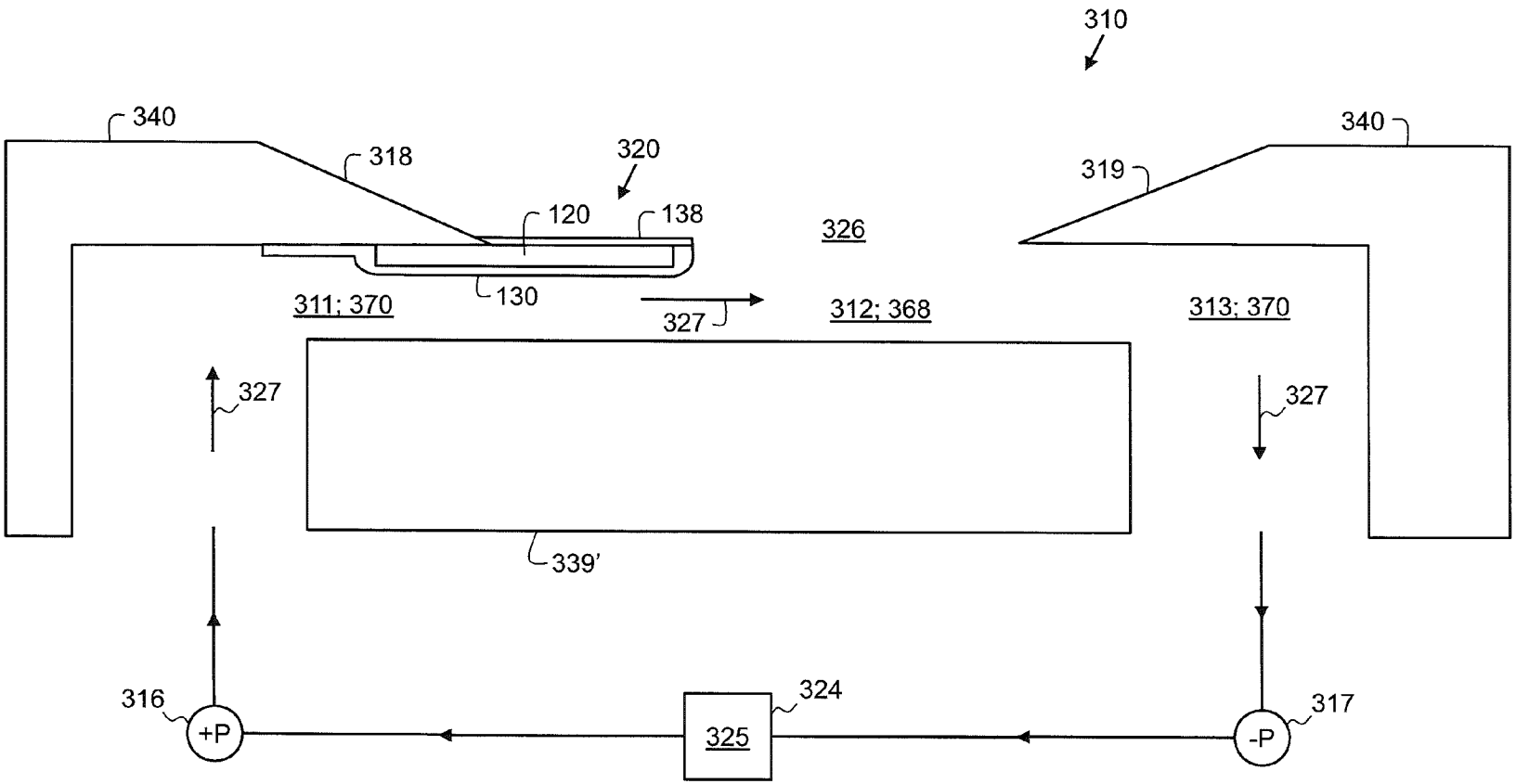
FIG. 25A is a schematic cross-sectional view of another example embodiment of a liquid dispenser made in accordance with the present invention.
Figure 25B:
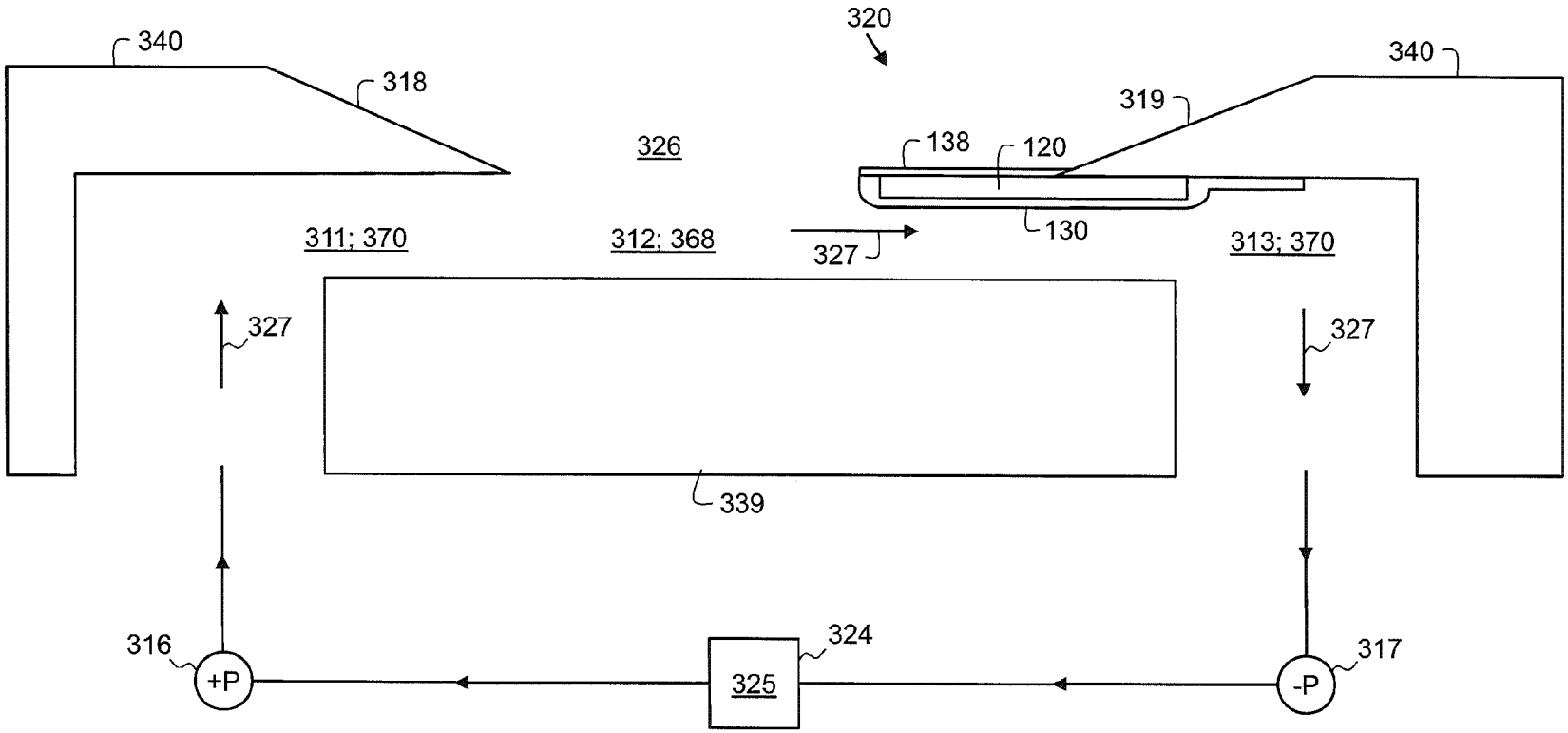
FIG. 25B is a schematic cross-sectional view of another example embodiment of a liquid dispenser made in accordance with the present invention.

The continuous flow of liquid 325 flows in a direction 327. As shown in FIG. 25A, diverter member 320 is positioned on an upstream side of wall 340 of liquid dispensing channel 312 that includes outlet opening 326 relative to the direction 327 of liquid flow. In this configuration, the free end of the diverter member 320 moves toward outlet 326 when actuated (shown in FIG. 25D) causing the diverter member to be curved away from the liquid dispensing channel 312. At least a portion of the flow of liquid moving through the liquid dispensing channel 312 adjacent to the outward curvature of the diverter member 320 will stay attached to the curved diverter member, diverting a portion of the flow toward the outlet 326 and creating an ejected drop 315. As shown in FIG. 25B, diverter member 320 is positioned on a downstream side of wall 340 of liquid dispensing channel 312 that includes outlet opening 326 relative to the direction 327 of liquid flow. In this configuration, diverter member 320 moves toward liquid dispensing channel 312 when actuated (shown in FIG. 25D). As the free end of the diverter member dips into the flow of liquid through the liquid dispensing channel, a portion of the flow is sheared off by the diverter member and directed toward the outlet 326, forming an ejected drop 315. In the embodiment shown in FIG. 25D and FIG. 25E, the diverter member 320 includes a first MEMS transducing member and a second MEMS transducing member positioned one on the upstream and one on the downstream sides of the outlet opening 326. The first and second MEMS transducing members can be actuated individually or together to divert a portion of the liquid flow toward the outlet to eject a drop 315.

Figure 26B:
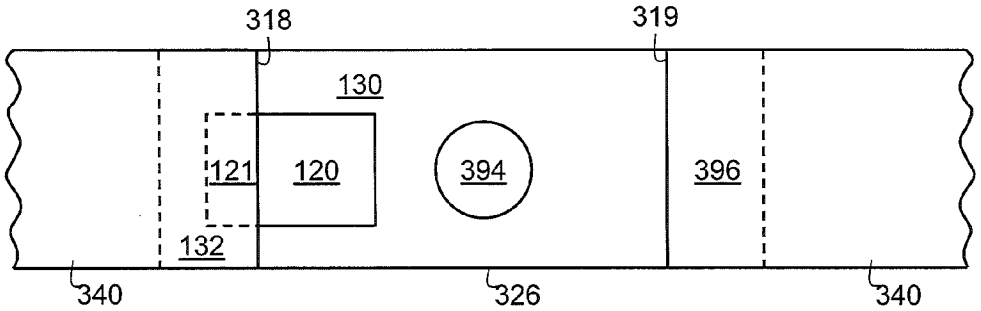
FIGS. 26A and 26B are schematic plan views of a diverter member of another example embodiment of a liquid dispenser made in accordance with the present invention.
Figure 26A:
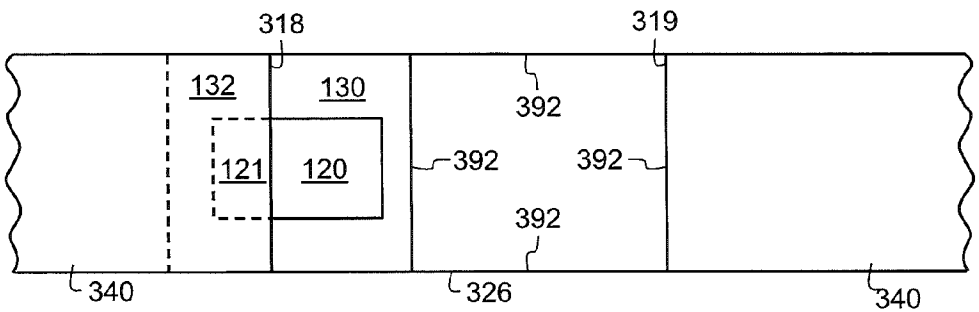

Referring to FIGS. 26A and 26B, in some example embodiments, compliant membrane 130 defines a portion of the perimeter 392 of outlet opening 326. In other example embodiments, compliant membrane includes an orifice 394. First portion 121 of the MEMS transducing member and second 132 portion of compliant membrane 130 are anchored to the portion (for example, an upstream wall portion or a downstream wall portion) of wall 340 of liquid dispensing channel 312 that includes outlet opening 326. A third portion 396 of compliant membrane 130 is anchored to another portion (for example, a downstream wall portion or an upstream wall portion, respectively) of wall 340 of liquid dispensing channel 312 that includes outlet opening 326. In this configuration, orifice 394 of compliant membrane 130 defines the perimeter 392 of outlet opening 326. Orifice 394 can be located between second portion 132 of compliant membrane 130 and third portion 396 of compliant membrane 130.

Figure 25C:
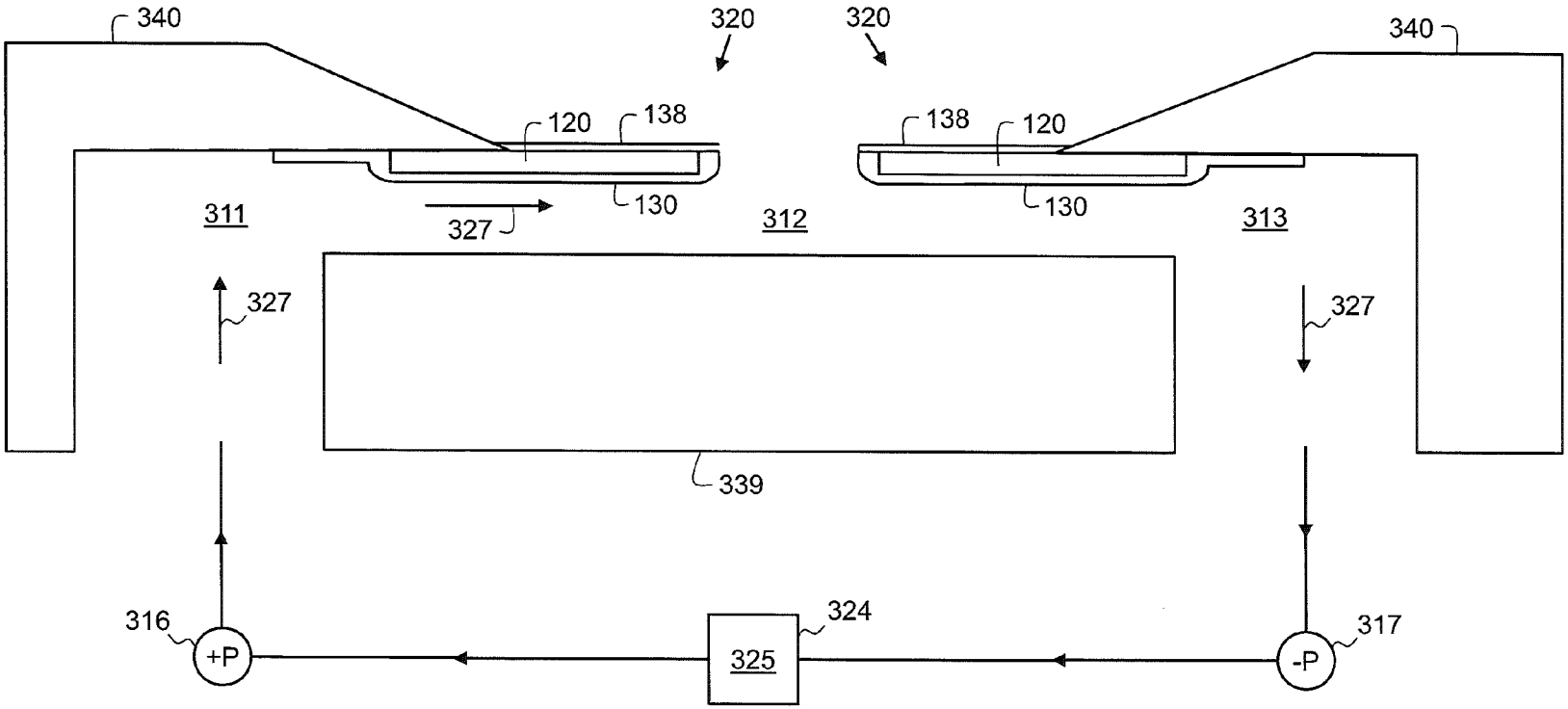
FIG. 25C is a schematic cross-sectional view of another example embodiment of a liquid dispenser made in accordance with the present invention.
Figure 25D:
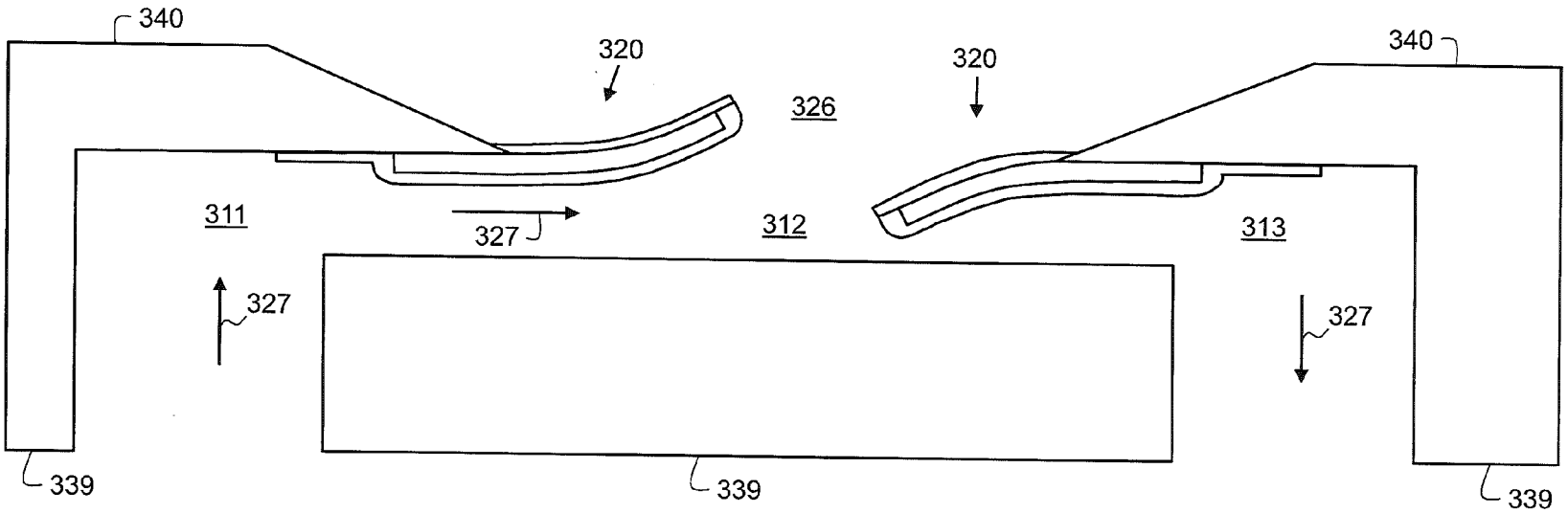
FIG. 25D is a schematic cross-sectional view of showing actuation of the diverter member of the liquid dispenser shown in FIG. 25C.
Figure 25E:
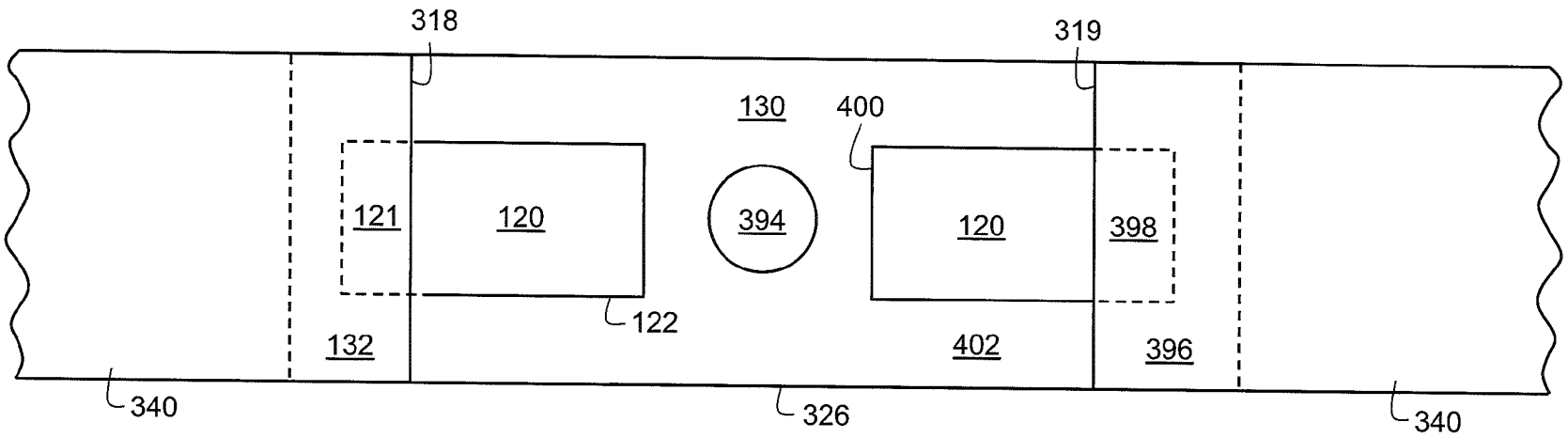
FIG. 25E is a schematic plan view of the diverter member of the liquid dispenser shown in FIG. 25C.

In FIGS. 25C, 25D, and 25E diverter member 320 includes a first MEMS transducing member and a second MEMS transducing member. The second MEMS transducing member is positioned opposite the first MEMS transducing member. A first portion 398 of the second MEMS transducing member is anchored to another portion of wall 340 of liquid dispensing channel 312 that includes the outlet opening 326. As shown, each of the first and second MEMS transducing members includes cantilevered beam 120 and first portion 398 of the second MEMS transducing member is anchored to a portion of wall 340 (a downstream wall portion) that is opposite the location where first portion 121 of the first MEMS transducing member is anchored to wall 340 (an upstream wall portion).

A second portion 400 of the MEMS transducing member extends into a portion of liquid dispensing channel 312 that is adjacent to outlet opening 326. Second portion 400 of the second MEMS transducing member is free to move relative to outlet opening 326. Compliant membrane 130 is positioned in contact with the second MEMS transducing member. A fourth portion 402 of compliant membrane 130 separates the second MEMS transducing member from the continuous flow 327 of liquid 325 through liquid dispensing channel 312. As shown, third portion 396 of compliant membrane 130 is anchored to a downstream wall portion of wall 340 of liquid dispensing channel 312 and second 132 portion of compliant membrane 130 is anchored to an upstream wall portion of wall 340 of liquid dispensing channel 312.

Compliant membrane 130 is initially positioned in a plane. The MEMS transducing member and the second MEMS transducing member are configured to be actuated out of the plane of compliant membrane 130. As shown in FIG. 25D, the first MEMS transducing member and the second MEMS transducing member are actuated in opposite directions. The first MEMS transducing member, anchored to an upstream wall portion of wall 340 of liquid dispensing channel 312, moves toward outlet 326 when actuated. The second MEMS transducing member, anchored to a downstream wall portion of wall 340 of liquid dispensing channel 312, moves toward liquid dispensing channel 312 when actuated.

Figure 27:
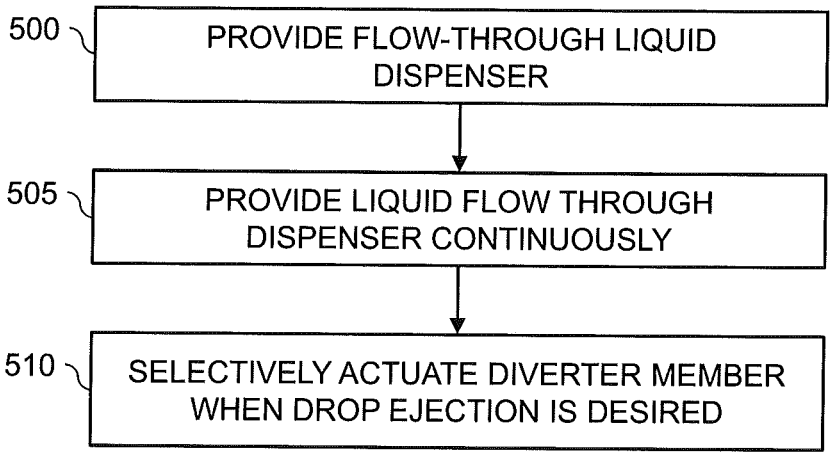
FIG. 27 shows a block diagram describing an example embodiment of a method of ejecting liquid using the liquid dispenser described herein.

Referring to FIG. 27, an example embodiment of a method of ejecting liquid using the liquid dispenser described above is shown. The method begins with step 500.

In step 500, a liquid dispenser is provided. The liquid dispenser includes a substrate and a diverter member. A first portion of the substrate defines a liquid dispensing channel including an outlet opening. A second portion of the substrate defines a liquid supply channel and a liquid return channel. The diverter member is positioned on a wall of the liquid dispensing channel that includes the outlet opening. The diverter member includes a MEMS transducing member. A first portion of the MEMS transducing member is anchored to the wall of the liquid dispensing channel that includes the outlet opening and a second portion of the MEMS transducing member extends into a portion of the liquid dispensing channel that is adjacent to the outlet opening. The second portion of the MEMS transducing member is free to move relative to the outlet opening. A compliant membrane is positioned in contact with the MEMS transducing member. A first portion of the compliant membrane separates the MEMS transducing member from the liquid dispensing channel. A second portion of the compliant membrane is anchored to the wall of the liquid dispensing channel that includes the outlet opening. Step 500 is followed by step 505.

In step 505, a continuous flow of liquid is provided from a liquid supply through the liquid supply channel through the liquid dispensing channel through the liquid return channel and back to the liquid supply. Step 505 is followed by step 510.

In step 510, the diverter member is selectively actuated to divert a portion of the liquid flowing through the liquid dispensing channel through outlet opening of the liquid dispensing channel when drop ejection is desired.

The invention has been described in detail with particular reference to certain preferred embodiments thereof, but it will be understood that variations and modifications can be effected within the scope of the invention.

PARTS LIST

100 MEMS composite transducer
110 substrate
111 first surface of substrate
112 second surface of substrate
113 portions of substrate (defining outer boundary of cavity)
114 outer boundary
115 cavity
116 through hole (fluid inlet)
118 mass
120 cantilevered beam
121 anchored end (of cantilevered beam)
122 cantilevered end (of cantilevered beam)
130 compliant membrane
131 covering portion of compliant membrane
132 anchoring portion of compliant membrane
133 portion of compliant membrane overhanging cavity
134 portion where compliant membrane is removed
135 hole (in compliant membrane)
138 compliant passivation material
140 doubly anchored beam
141 first anchored end
142 second anchored end
143 intersection region
150 clamped sheet
151 outer boundary (of clamped sheet)
152 inner boundary (of clamped sheet)
160 MEMS transducing material
162 reference material
163 first layer (of reference material)
164 second layer (of reference material)
165 third layer (of reference material)
166 bottom electrode layer
167 seed layer
168 top electrode layer
171 first region (where transducing material is retained)
172 second region (where transducing material is removed)
200 fluid ejector
201 chamber
202 partitioning walls
204 nozzle plate
205 nozzle
310 liquid dispenser
311 liquid supply channel
312 liquid dispensing channel
313 liquid return channel
315 drop
316 regulated pressure supply source
317 regulated vacuum supply source
318 upstream edge
319 downstream edge
320 diverter member
320A first side
320B second side
321 exit
322 porous member
323 vent
324 liquid supply
325 liquid
326 outlet opening
327 arrows, flow direction
331 second liquid supply channel
334 second liquid return channel
335 second regulated pressure source
336 second regulated vacuum supply
338 entrance
339 substrate
340 wall
342 liquid supply passage
344 liquid return passage
346 wall
348 wall
350 upstream edge
352 downstream edge
354 surface
354A interior surface
3548 exterior surface
356 corners
358 centerline
360 centerline
362 apex
364 width
366 width
368 first portion
370 second portion
372 other portions
374 other portions
376 wall
378 upstream portion
380 second wall
382 downstream portion
384 second liquid
386 second liquid supply
388 arrows
390 cavity
392 outlet opening perimeter
394 orifice
396 third portion
398 first portion
400 second portion
402 fourth portion
500 provide flow-through liquid dispenser
505 provide liquid flow through dispenser continuously
510 selectively actuate diverter member when drop ejection is desired

The invention claimed is:

1. A method of ejecting a liquid from a liquid dispenser comprising:

providing the liquid dispenser including:

a substrate, a first portion of the substrate defining a liquid dispensing channel including an outlet opening, a second portion of the substrate defining a liquid supply channel and a liquid return channel; and a diverter member positioned on a wall of the liquid dispensing channel that includes the outlet opening, the diverter member including:

a MEMS transducing member, a first portion of the MEMS transducing member being anchored to the wall of the liquid dispensing channel that includes the outlet opening, a second portion of the MEMS transducing member extending into a portion of the liquid dispensing channel that is adjacent to the outlet opening, the second portion of the MEMS transducing member being free to move relative to the outlet opening; and a compliant membrane positioned in contact with the MEMS transducing member, a first portion of the compliant membrane separating the MEMS transducing member from the continuous flow of liquid through the liquid dispensing channel, and a second portion of the compliant membrane being anchored to the wall of the liquid dispensing channel that includes the outlet opening;

providing a continuous flow of liquid from a liquid supply through the liquid supply channel through the liquid dispensing channel through the liquid return channel and back to the liquid supply; and selectively actuating the diverter member to divert a portion of the liquid flowing through the liquid dispensing channel through outlet opening of the liquid dispensing channel;

wherein the first portion of the MEMS transducing member and the second portion of the compliant membrane being anchored to the same wall of the liquid dispensing channel that includes the outlet opening, the compliant membrane including an orifice, a third portion of the compliant membrane being anchored to another portion of the wall of the liquid dispensing channel that includes the outlet opening such that the orifice of the compliant membrane defines a perimeter of the outlet opening.

2. The method of claim 1, the liquid flowing in a direction, wherein the diverter member is positioned on an upstream wall of the liquid dispensing channel as viewed relative to the direction of liquid flow.

3. The method of claim 2, the compliant membrane being positioned in a plane, wherein selectively actuating the diverter member includes actuating the diverter member out of the plane of the compliant membrane.

4. The method of claim 3, wherein actuating the diverter member out of the plane of the compliant membrane includes actuating the MEMS transducing member of the diverter member toward the outlet opening of the liquid dispensing channel.

5. The method of claim 1, the liquid flowing in a direction, wherein the diverter member is positioned on a downstream wall of the liquid dispensing channel as viewed relative to the direction of liquid flow.

6. The method of claim 5, the compliant membrane being positioned in a plane, wherein selectively actuating the diverter member includes actuating the diverter member out of the plane of the compliant membrane.

7. The method of claim 6, wherein actuating the diverter member out of the plane of the compliant membrane includes actuating the MEMS transducing member of the diverter member toward the liquid dispensing channel.

8. The method of claim 1, wherein the orifice is located between the second portion of the compliant membrane and the third portion of the compliant membrane.

9. The method of claim 1, the MEMS transducing member being a first MEMS transducing member, the diverter member including:

a second MEMS transducing member positioned opposite the first MEMS transducing member, a first portion of the second MEMS transducing member being anchored to another portion of the wall of the liquid dispensing channel that includes the outlet opening, a second portion of the MEMS transducing member extending into a portion of the liquid dispensing channel that is adjacent to the outlet opening, the second portion of the second MEMS transducing member being free to move relative to the outlet opening, the compliant membrane positioned in contact with the second MEMS transducing member, a fourth portion of the compliant membrane separating the second MEMS transducing member from the continuous flow of liquid through the liquid dispensing channel.

10. The method of claim 9, the compliant membrane positioned in a plane, wherein selectively actuating the diverter member includes actuating the diverter member out of the plane of the compliant membrane.

11. The method of claim 10, wherein actuating the diverter member out of the plane of the compliant membrane includes actuating the first MEMS transducing member and the second MEMS transducing member in opposite directions.

12. The method of claim 1, wherein the compliant membrane is a compliant polymeric membrane.

* * * * *